US008149255B2

(12) United States Patent
Higuchi et al.

(10) Patent No.: US 8,149,255 B2
(45) **Date of Patent: *Apr. 3, 2012**

(54) IMAGE FORMING APPARATUS AND MODIFICATION SHEET CARTRIDGE USING THE SAME

(75) Inventors: Ken Higuchi, Kanagawa (JP); Takaaki Murakami, Kanagawa (JP); Hiromi Tsujie, Kanagawa (JP)

(73) Assignee: Sony Corporation, Tokyo (JP)

( * ) Notice: Subject to any disclaimer, the term of this patent is extended or adjusted under 35 U.S.C. 154(b) by 572 days.

This patent is subject to a terminal disclaimer.

(21) Appl. No.: 12/353,593

(22) Filed: Jan. 14, 2009

(65) Prior Publication Data

US 2009/0185023 A1 Jul. 23, 2009

(30) Foreign Application Priority Data

Jan. 17, 2008 (JP) ..... 2008-007627

(51) Int. Cl.
*B41J 33/00* (2006.01)

(52) U.S. Cl. ..... 347/175; 347/214

(58) Field of Classification Search ..... 347/171, 347/172, 173, 175, 176, 212, 213, 214; 400/194, 400/196, 102.01–120.04
See application file for complete search history.

(56) References Cited

U.S. PATENT DOCUMENTS 4,666,320 A * 5/1987 Kobayashi et al. ..... 400/241.1
5,965,485 A * 10/1999 Mizumachi et al. ..... 503/227
5,978,005 A * 11/1999 Hadley ..... 347/177
6,092,942 A * 7/2000 Koichi et al. ..... 400/120.02
6,860,658 B2 * 3/2005 Tischer ..... 400/207
7,425,064 B2 * 9/2008 Koga ..... 347/108
2007/0182807 A1 * 8/2007 Sawada et al. ..... 347/213
2009/0035493 A1 * 2/2009 Murakami et al. ..... 428/32.77

FOREIGN PATENT DOCUMENTS

JP 2004-122756 4/2004
JP 2007-076332 3/2007

* cited by examiner

*Primary Examiner* — Julian Huffman
*Assistant Examiner* — Sharon A Polk
(74) *Attorney, Agent, or Firm* — SNR Denton US LLP

(57) ABSTRACT

An image forming apparatus includes a conveying unit that conveys a recording medium in a predetermined direction, a thermal transfer sheet traveling unit that causes a thermal transfer sheet to travel in a predetermined direction, a modification sheet moving unit that moves a surface modification sheet, a thermal head that applies thermal energy and thermally transfers sequentially a dye layer and a protective layer of the thermal transfer sheet onto the recording medium while the dye layer or the protective layer opposes the surface of the recording medium, and a modification sheet protecting unit disposed in a movement path of the surface modification sheet, and configured to prevent adhesion of dust to the surface modification sheet or to eliminate the adhesion. After forming the image onto the recording medium using the thermal transfer sheet and forming the protective layer that protects the image, the surface modification portion of the surface modification sheet is aligned with a plane in which the protective layer is formed, so that heat and pressure are applied by the thermal head to modify the surface state of the protective layer formed at the recording medium.

13 Claims, 11 Drawing Sheets

IMAGE FORMING APPARATUS AND MODIFICATION SHEET CARTRIDGE USING THE SAME

CROSS REFERENCES TO RELATED APPLICATIONS

The present invention contains subject matter related to Japanese Patent Application JP 2008-007627 filed in the Japanese Patent Office on Jan. 17, 2008, the entire contents of which are incorporated herein by reference.

BACKGROUND OF THE INVENTION

1. Field of the Invention

The present invention relates to an image forming apparatus in which an image is formed on a recording medium using a thermal transfer sheet and a protective layer that protects a surface of the image is formed. More particularly, the present invention relates to an image forming apparatus that modifies a surface state of the protective layer (formed on the image of the recording medium) to give it, for example, glossiness or a mat tone, and that takes measures against dust to improve the quality of a surface state of a printed material; and relates to a modification sheet cartridge using the image forming apparatus.

2. Description of the Related Art

As a related image forming apparatus, a sublimation apparatus that forms an image by transferring a dye layer of a thermal transfer sheet onto a recording medium is available. In this type of apparatus, a transparent protective layer for protecting a surface of the image formed on the recording medium is formed on the image. The protective layer has, for example, the function of shielding the image from gas that causes the image to deteriorate, the function of preventing discoloration and fading of the image caused by absorption of ultraviolet light, the function of preventing, for example, dye (forming the image) from flowing onto various plastic articles, such rubber, the function of preventing wearing of the image, and the function of protecting the image from sebum.

The above-described protective layer is provided by, for example, laminating it upon a ribbon base sheet, and is thermally transferred onto the image by a thermal head. By being thermally transferred onto the image, the protective layer can prevent, for example, curling of the recording medium, as well as protect the image. When the protective layer is thermally transferred using the thermal head, it is possible to arbitrarily change thermal energy from the thermal head to form a very small uneven pattern, so that its surface is subjected to surface treatment to give it, for example, glossiness or a mat tone.

In addition, in the related image forming apparatus, a recording medium having a receiving layer (which receives dye) formed on a thermoplastic base material is conveyed, and a thermal transfer sheet having a dye layer and a protective layer formed side by side on a sheet in a travel direction is caused to travel. While the receiving layer of the recording medium and the dye layer of the thermal transfer sheet oppose each other, thermal energy is applied by the thermal head, to thermally transfer the dye layer of the thermal transfer sheet to the receiving layer of the recording medium, so that an image is formed. While the image formed on the recording medium and the protective layer of the thermal transfer sheet oppose each other, thermal energy is applied by the thermal head, to thermally transfer the protective layer of the thermal transfer sheet onto the image formed on the recording medium (refer to, for example, Japanese Unexamined Patent Application Publication No. 2007-76332).

SUMMARY OF THE INVENTION

However, in a protective-layer integrated type thermal transfer sheet in the related image forming apparatus, the dye layer for forming the image is either directly formed on the base sheet, or is formed on the base sheet via a layer, which is called an adhesion layer, for stabilizing adhesion. In addition, in general, a heat-resistant sliding layer for, for example, reducing friction between the thermal head and the thermal transfer sheet during printing to cause the thermal transfer sheet to travel stably is formed on the back side of the base sheet (that is, the side opposite to the side where the dye layer is formed).

Considering transferability when thermally transferring the protective layer for protecting the image onto the recording medium, a peeling layer is provided on the adhesion layer formed on the base sheet, so that the protective layer is formed above the base sheet via the peeling layer. When the protective layer is being transferred onto the recording medium, peeling occurs at a boundary between the peeling layer and the protective layer. The peeling layer remains at the thermal-transfer-sheet side, and only the protective layer is thermally transferred onto the recording medium to protect a printed material. For the protective layer and the peeling layer, a combination of materials that can be easily peeled at the boundary between the protective layer and the peeling layer is used. When the protective layer is being transferred from the thermal transfer sheet to the recording medium, interfacial peeling occurs at the boundary between the protective layer and the peeling layer. In this way, the protective layer is formed on an uppermost layer of the image formed on the recording medium. Since the surface of the protective layer is smooth to a certain extent, a printed material having glossiness can be obtained.

However, since the peeling layer for peeling the above-described protective layer is formed by applying resin to the adhesion layer formed on the base sheet, and by drying the resin, the peeling layer does not have sufficient smoothness. Since a peeling surface provided for when the protective layer is transferred from the thermal transfer sheet is influenced by the smoothness of the surface of the peeling layer, the smoothness of the surface of the protective layer at the uppermost layer of a printed material is not sufficient. Therefore, the printed material obtained by the related image forming apparatus does not have sufficient glossiness, as a result of which, in general, its glossiness is of a lower level than that of silver halide photography. For a printed material of a natural image, such as a color photograph, a surface-finished printed material is required to have, for example, a mat tone, in addition to glossiness.

Accordingly, it is desirable to provide an image forming apparatus that can overcome such problems and that modifies a surface state of a protective layer formed on an image on a recording medium to give it, for example, glossiness or a mat tone. In addition, it is desirable to provide a modification sheet cartridge using the image forming apparatus.

According to a first embodiment of the present invention, there is provided an image forming apparatus including conveying means for conveying a recording medium in a predetermined direction; thermal transfer sheet traveling means for causing a thermal transfer sheet to travel in a predetermined direction, the thermal transfer sheet having a dye layer and a protective layer disposed side by side on a ribbon base sheet in a longitudinal direction of the base sheet, the dye layer being thermally transferred onto a surface of the recording medium to form an image thereon, the protective layer being thermally transferred onto a surface of the image formed on the surface of the recording medium to protect the image; modification sheet moving means for moving a surface modification sheet, the surface modification sheet having a print open portion and a surface modification portion disposed side by side at a ribbon base sheet in a longitudinal direction of the base sheet, the print open portion being provided so as to allow the thermal transfer sheet to directly contact the surface of the recording medium, the surface modification portion being provided to modify a surface state of the protective layer that protects the image formed on the recording medium; a thermal head that applies thermal energy and thermally transfers sequentially the dye layer and the protective layer onto the recording medium while the dye layer or the protective layer of the thermal transfer sheet opposes the surface of the recording medium; and modification sheet protecting means, disposed in a movement path of the surface modification sheet, for preventing adhesion of dust to the surface modification sheet or for eliminating the adhesion. In the image forming apparatus, after forming the image onto the recording medium using the thermal transfer sheet and forming the protective layer that protects the image, the surface modification portion of the surface modification sheet is aligned with a plane in which the protective layer is formed, so that heat and pressure are applied by the thermal head to modify the surface state of the protective layer formed at the recording medium.

By virtue of such a structure, the conveying means conveys the recording medium in the predetermined direction. The thermal-transfer-sheet traveling means causes the thermal transfer sheet to travel in the predetermined direction. The thermal transfer sheet has the dye layer and the protective layer disposed on the ribbon base sheet side by side in the longitudinal direction of the base sheet. The dye layer is thermally transferred onto the surface of the recording medium to form an image. The protective layer is thermally transferred onto the surface of the image formed on the surface of the recording medium to protect the image. The modification sheet moving means moves the surface modification sheet having the print open portion and the surface modification portion disposed on the ribbon base sheet side by side in the longitudinal direction of the base sheet. The print open portion is disposed so that the thermal transfer sheet directly contacts the surface of the recording medium. The surface modification portion is provided for modifying the surface state of the protective layer that protects the image formed on the recording medium. While the protective layer or the die layer of the thermal transfer sheet opposes the surface of the recording medium, the thermal head applies thermal energy to thermally transfer sequentially the die layer and the protective layer onto the recording medium. The modification sheet protecting means disposed in the movement path of the surface modification sheet prevents or eliminates adhesion of dust to the surface modification sheet, so that after forming the image onto the recording medium using the thermal transfer sheet and forming the protective layer that protects the image, the surface modification portion of the surface modification sheet is aligned with the plane where the protective layer is formed. Then, the thermal head applies heat and pressure to modify the surface state of the protective layer formed on the recording medium.

According to a second embodiment of the present invention, there is provided a modification sheet cartridge used in an image forming apparatus in which, after forming an image onto a recording medium using a thermal transfer sheet and forming a protective layer that protects the image, a surface modification portion, disposed at a surface modification sheet, for modifying a surface state of the protective layer is aligned with a plane in which the protective layer is formed, so that heat and pressure are applied by the thermal head to modify the surface state of the protective layer formed on the recording medium. The modification sheet cartridge includes two reels upon which the surface modification sheet is placed so that the surface modification sheet is capable of being taken up and rewound, the two reels being disposed apart from each other by a predetermined distance so as to oppose each other; a protective cover that covers a vicinity of a movement path of the surface modification sheet excluding a portion of the surface modification sheet, placed between the two reels, corresponding to the thermal head; and modification sheet dust processing means for removing dust adhered to the surface modification sheet, the modification sheet dust processing means being disposed in the movement path of the surface modification sheet between the two reels.

By virtue of such a structure, the surface modification sheet is placed upon the two reels that are separated from each other by a predetermined distance and that oppose each other so as to be capable of being taken up or rewound upon the reels. The protective cover disposed around the movement path of the surface modification sheet covers the vicinity of the movement path of the surface modification sheet excluding a portion of the surface modification sheet, placed between the two reels, corresponding to the thermal head. The modification sheet dust processing means, disposed in the movement path of the surface modification sheet between the two reels, removes dust adhered to the surface modification sheet.

According to the image forming apparatus according to the first embodiment of the present invention, the conveying means conveys the recording medium in the predetermined direction. The thermal-transfer-sheet traveling means causes the thermal transfer sheet to travel in the predetermined direction. The thermal transfer sheet has the dye layer and the protective layer disposed on the ribbon base sheet side by side in the longitudinal direction of the base sheet. The dye layer is thermally transferred onto the surface of the recording medium to form an image. The protective layer is thermally transferred onto the surface of the image formed on the surface of the recording medium to protect the image. The modification sheet moving means moves the surface modification sheet having the print open portion and the surface modification portion disposed on the ribbon base sheet side by side in the longitudinal direction of the base sheet. The print open portion is disposed so that the thermal transfer sheet directly contacts the surface of the recording medium. The surface modification portion is provided for modifying the surface state of the protective layer that protects the image formed on the recording medium. While the protective layer or the die layer of the thermal transfer sheet opposes the surface of the recording medium, the thermal head applies thermal energy to thermally transfer sequentially the die layer and the protective layer onto the recording medium. The modification sheet protecting means disposed in the movement path of the surface modification sheet prevents or eliminates adhesion of dust to the surface modification sheet, so that after forming the image onto the recording medium using the thermal transfer sheet and forming the protective layer that protects the image, the surface modification portion of the surface modification sheet is aligned with the plane where the protective layer is formed. Then, the thermal head applies heat and pressure to modify the surface state of the protective layer formed on the recording medium. In addition, depending upon the type of surface modification portion of the surface modification sheet, the surface state of the protective layer formed on the image on the recording medium is modified to give it, for example, glossiness or a mat tone, and measures are taken against dust to improve the quality of the surface state of printed material.

In a first form according to the first embodiment, the modification sheet protecting means includes a protective cover that covers a vicinity of the movement path of the surface modification sheet excluding a portion corresponding to the thermal head. Therefore, it is possible to prevent dust floating in the vicinity of the surface modification sheet from adhering to the surface modification sheet, and to prevent scratching of the surface modification sheet occurring when a nearby hard object comes into contact with the surface modification sheet. Consequently, it is possible to improve the quality of the surface state of printed material.

In a second form, the modification sheet protecting means includes either one of or both of a dust removing tool and a static electricity removing tool, the dust removing tool removing the dust adhered to the surface modification sheet, the static electricity removing tool allowing static electricity generated at the surface modification sheet to escape. Therefore, it is possible to wipe off dust adhered to the surface modification sheet with a dust removing tool or remove the dust adhered to the surface modification sheet by, for example, wiping it off with the dust removing tool. In addition, it is possible to cause static electricity generated at the surface modification sheet to escape using the static electricity removing tool to prevent adhesion of dust. Consequently, it is possible to improve the quality of the surface state of printed material.

In a third form, the thermal transfer sheet has a plurality of the dye layers of one or a plurality of colors and the protective layer successively disposed on a surface of the ribbon base sheet, and has position detection marks disposed near the respective dye layers and the protective layer. The position detection marks thereof can be detected by detecting means provided in a travel path of the thermal transfer sheet. Therefore, it is possible to detect the positions of the dye layers and the protective layer formed on the thermal transfer sheet to align the predetermined dye layer or protective layer with the position of the thermal head.

In a fourth form, the surface modification sheet has a plurality of the surface modification portions of one or a plurality of types successively disposed on a surface of the ribbon base sheet. The plurality of the surface modification portions are provided for modifying the surface state of the protective layer formed at the recording medium into one or different types of surface states. The surface modification sheet also has position detection marks disposed near the print open portion and the respective surface modification portions. The position detection marks thereof can be detected by detecting means provided in the movement path of the surface modification sheet. Therefore, it is possible to detect the positions of the print open portion and the surface modification portions formed on the surface modification sheet to align the print open portion or the predetermined surface modification portion with the position of the thermal head.

According to the modification sheet cartridge according to the second embodiment, the two reels disposed apart from each other by a predetermined distance so as to oppose each other have the surface modification sheet placed thereupon so that the surface modification sheet is capable of being taken up and rewound. In addition, the protective cover provided in the vicinity of the movement path of the surface modification sheet covers the vicinity of the movement path of the surface modification sheet excluding a portion of the surface modification sheet, placed between the two reels, corresponding to the thermal head. Further, the modification sheet dust processing means disposed in the movement path of the surface modification sheet between the two reels can remove dust adhered to the surface modification sheet. Therefore, in this single modification sheet cartridge, it is possible to prevent dust floating in the vicinity of the surface modification sheet from adhering to the surface modification sheet, and to prevent scratching of the surface modification sheet occurring when a nearby hard object comes into contact with the surface modification sheet. Consequently, it is possible to improve the quality of the surface state of printed material.

In a first form according to the second embodiment, the modification sheet dust processing means includes either one of or both of a dust removing tool, which removes the dust adhered to the surface modification sheet, and a static electricity removing tool, which allows static electricity generated at the surface modification sheet to escape. Therefore, it is possible to wipe off dust adhered to the surface modification sheet with the dust removing tool or remove the dust adhered to the surface modification sheet by, for example, wiping it off with the dust removing tool. In addition, it is possible to cause static electricity generated at the surface modification sheet to escape using the static electricity removing tool to prevent adhesion of dust. Consequently, it is possible to improve the quality of the surface state of printed material.

In a fifth form according to the first embodiment or a second form according to the second embodiment, the surface modification portion of the surface modification sheet gives glossiness to the surface state of the protective layer that protects the image formed on the recording medium. Therefore, it is possible to provide the surface state of the protective layer with glossiness to finish the surface state of printed material to a glossy surface state.

In a sixth form according to the first embodiment or a third form according to the second embodiment, the surface modification portion of the surface modification sheet finishes to a mat tone state the surface state of the protective layer that protects the image formed on the recording medium. Therefore, it is possible to finish the surface state of the protective layer to one having a mat tone to finish the surface state of printed material to one having a mat tone.

DESCRIPTION OF THE PREFERRED EMBODIMENTS

Embodiments according to the present invention will hereunder be described in detail with reference to the attached drawings.

Figure 1:
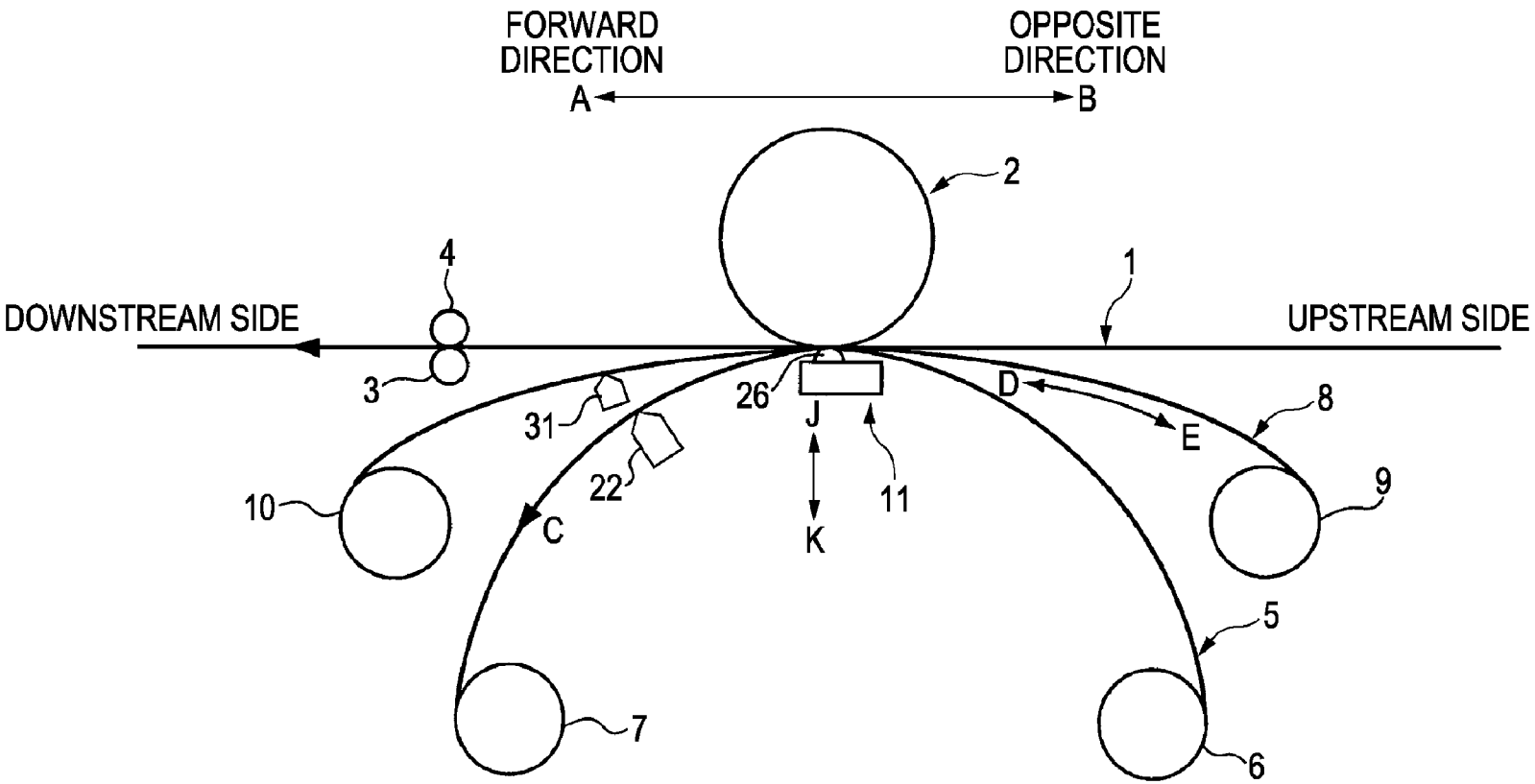
FIG. 1 is a schematic view of an image forming apparatus according to an embodiment of the present invention.

FIG. 1 is a schematic view of an image forming apparatus according to an embodiment of the present invention. The image forming apparatus (such as a thermal printer) forms an image onto a recording medium using a thermal transfer sheet, and a protective layer that protects the surface of the image. The image forming apparatus includes a platen roller 2 that holds a recording sheet 1, a pinch roller 3, a capstan roller 4, a supply reel 6 and a take-up reel 7 of a thermal transfer sheet 5, a supply reel 9 and a take-up reel 10 of a surface modification sheet 8, a thermal head 11, and dust removing tools 41*a* and 41*b*. In the description below, forming of an image onto the recording sheet 1 wound in the form of a roll (may hereunder be referred to as "printing") will be described.

The recording sheet 1 is a recording medium on which an image is formed in the image forming apparatus, and is, for example, a sublimation-transfer printing sheet. Here, the platen roller 2 holds the recording sheet 1 during printing. The pinch roller 3 and the capstan roller 4 nip the recording sheet 1 and rotate opposite to each other in synchronism with each other to feed the recording sheet 1 in a predetermined direction and to rewind the recording sheet 1 in the opposite direction. The platen roller 2, the pinch roller 3, the capstan roller 4, and a roller driving mechanism (not shown) constitute a conveying unit that conveys the recording sheet 1 in the predetermined direction.

For convenience for later explanations, the conveying direction of the recording sheet 1 is defined as follows. That is, a forward direction A in which the recording sheet 1 having an image formed thereon is conveyed to discharge it to the outside from the image forming apparatus is called "downstream side," and an opposite direction B is defined "upstream side."

The thermal transfer sheet 5 is used for forming an image by thermally transferring dye onto a surface of the recording sheet 1. As shown in FIG. 2, dye layers 13 of one or a plurality of colors and a protective layer 14 are formed on a ribbon base sheet 12 side by side in a longitudinal direction of the base sheet 12. This is what is ordinarily called an ink ribbon. The dye layers 13 are thermally transferred onto a surface of the recording sheet 1 to form an image. The protective layer 14 is thermally transferred onto a surface of the image formed on the surface of the recording sheet 1 to protect the image. The protective layer 14 is provided for increasing, for example, wear resistance and chemical resistance of the image formed on the surface of the recording sheet 1. By adding an ultraviolet absorber to the protective layer 14, light resistance of the image can also be increased. As the protective layer 14, a related thermoplastic resin, such as polystyrene resin, may be used. The protective layer 14 may include a plurality of adhesive layers disposed at a topmost layer of the protective layer. The adhesive layers are provided for achieving good adhesiveness of the protective layer 14 with respect to the recording sheet 1 and the surface of the image formed on the surface of the recording sheet 1. In the embodiment, the protective layer 14 has a two-layer structure including polystyrene resin and acrylic modification resin formed on top of the polystyrene resin.

Figure 2A:
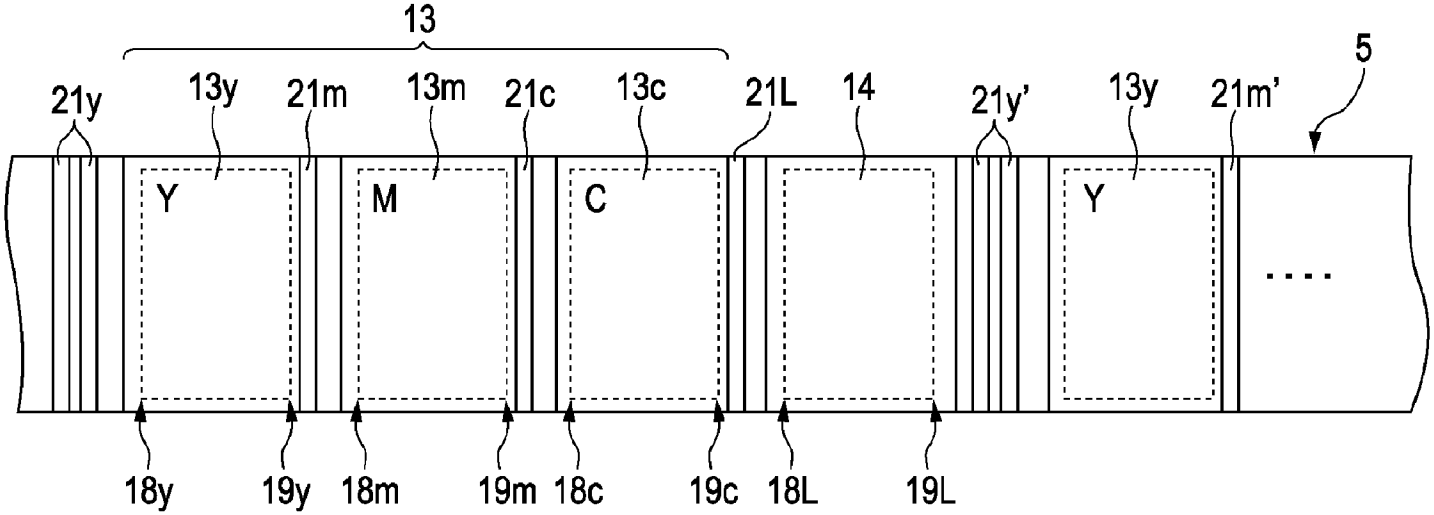
FIG. 2A is a plan view of an exemplary thermal transfer sheet used in the image forming apparatus.
Figure 2B:
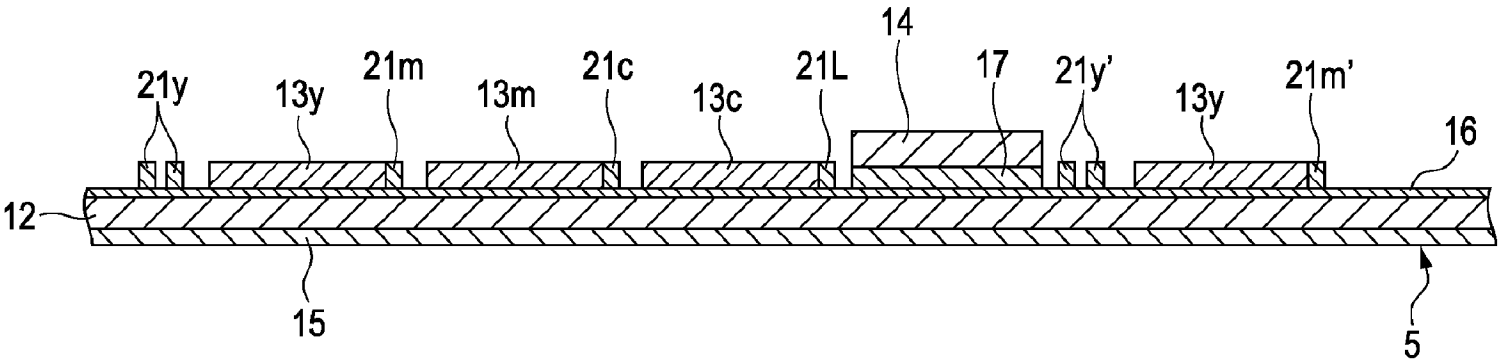
FIG. 2B is a central vertical sectional view of FIG. 2A.

That is, in FIG. 2B, a heat-resistant sliding layer 15 is formed on the back side of the ribbon base sheet 12, and an adhesion layer 16 is formed on the front side of the base sheet 12. The dye layers 13*y*, 13*m*, and 13*c*, which are, for example, yellow (Y), magenta (M), and cyan (C) dye layers, and the protective layer 14 are sequentially formed to predetermined thicknesses on the adhesion layer 16. The dye layers 13*y*, 13*m*, and 13*c* are used to form an image on the surface of the recording sheet 1 by, for example, sublimation transfer or fusion transfer. The protective layer 14 protects the image formed on the surface of the recording medium 1. A peeling layer 17 is interposed between the lower surface of the protective layer 14 and the adhesion layer 16. As shown in FIG. 2A, four regions, that is, the dye layers 13*y*, 13*m*, and 13*c*, and the protective layer 14, are defined as one structural unit. Using such structural units, one color image or black-and-white image is formed. For making it possible to print a plurality of images, these structural units are repeatedly formed along a longitudinal direction (winding direction) of the thermal transfer sheet 5. A black (Bk) dye layer may be included as a dye layer 13, in addition to the yellow (Y) dye layer, the magenta (M) dye layer, and the cyan (C) dye layer. Alternatively, only a black (Bk) dye layer may be used as a dye layer 13.

In FIG. 2, symbol 18*y* denotes a leading position of the yellow (Y) die layer 13*y*, and symbol 19*y* denotes a rear position of the dye layer 13*y*. Symbol 18*m* denotes a leading position of the magenta (M) dye layer 13*m*, and symbol 19*m* denotes a rear position of the dye layer 13*m*. Further, symbol 18*c* denotes a leading position of the cyan (C) dye layer 13*c*, and symbol 19*c* denotes a rear position of the dye layer 13*c*. Still further, symbol 18L denotes a leading position of the protective layer 14, and symbol 19L denotes a rear position of the protective layer 14.

In addition, in FIGS. 2A and 2B, symbol 21*y* denotes an ink position detection mark provided near the dye layer 13*y* and used for detecting the position of the dye layer 13*y* which is the leading region among all of the regions in which one structural unit is defined by the combination of the four regions (that is, the dye layers 13*y*, 13*m*, and 13*c*, and the protective layer 14). Symbol 21*m* denotes an ink position detection mark provided near the dye layer 13*m* and used for detecting the position of the dye layer 13*m*. Symbol 21*c* denotes an ink position detection mark provided near the dye layer 13*c* and used for detecting the position of the dye layer 13*c*. Symbol 21L denotes a protective layer position detection mark provided near the protective layer 14 and used for detecting the position of the protective layer 14. Symbol 21*y*' denotes another ink position detection mark provided near another dye layer 13*y*, which is a leading layer in a structural unit following the aforementioned structural unit including the dye layers 13 and the protective layer 14, and used for detecting the position of the another dye layer 13*y*.

Each position detection mark is a linear marking that crosses the ribbon base sheet 12. For example, the ink position detection marks 21*y* and 21*y*', which indicate the positions of their respective dye layers 13*y* (which are the leading layers of their respective structural units) each include two lines. The ink position detection marks 21*m* and 21*c*, which indicate the positions of their respective dye layers 13*m* and 13*c*, and the protective layer position detection mark 21L, which indicates the position of the protective layer 14, each include one line.

As shown in FIG. 1, the thermal transfer sheet 5 having such a structure is tightly stretched between the supply reel 6 and the take-up reel 7 and is accommodated in a ribbon cassette (not shown). The ribbon cassette is removably provided in the body of the apparatus. When the ribbon cassette is mounted in the body of the apparatus, the thermal transfer sheet 5 is nipped between the platen roller 2 and the thermal head 11, synchronizes with the conveyance of the recording sheet 1, and travels in the direction of arrow C. Here, the supply reel 6 and the take-up reel 7 constitute a thermal-transfer-sheet traveling unit that causes the thermal transfer sheet 5 to travel in a predetermined direction. The thermal transfer sheet 5, the supply reel 6, and the take-up reel 7 may not be accommodated in the ribbon cassette. They may be set in predetermined locations of the body of the apparatus, and operated.

A light sensor 22 is disposed in a travel path of the thermal transfer sheet 5 that is caused to travel by the thermal-transfer-sheet traveling unit. The light sensor 22 is a detecting unit that detects the various position detection marks 21*y*, 21*y*', 21*m*, 21*c*, and 21L of the thermal transfer sheet 5. As shown in FIG. 1, the light sensor 22 is disposed at a position that is separated by a predetermined distance from the thermal head 11 in the travel direction, indicated by the arrow C, when printing onto the recording sheet 1. Therefore, when the various position detection marks 21*y*, 21*y*', 21*m*, 21*c*, and 21L are detected, the positions of the dye layers 13*y*, 13*m*, and 13*c*, and the protective layer 14, shown in FIG. 2, are aligned with a recording portion of the thermal head 11.

Figure 3A:
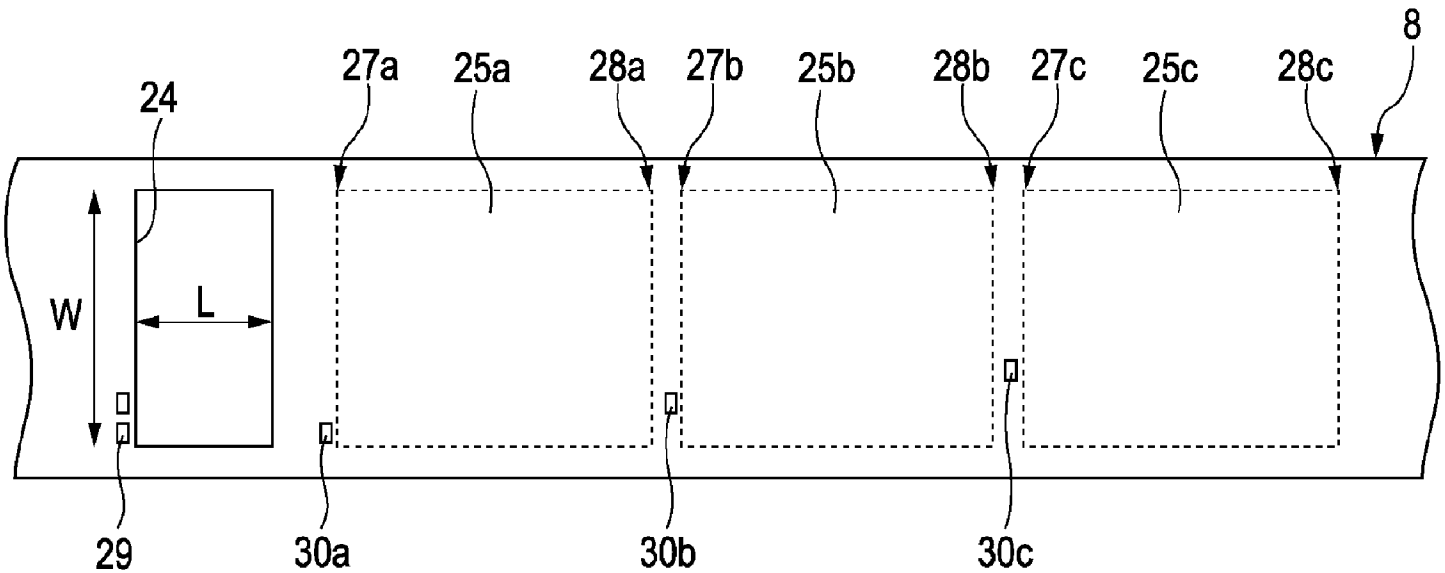
FIG. 3A is a plan view of an exemplary surface modification sheet used in the image forming apparatus.
Figure 3B:
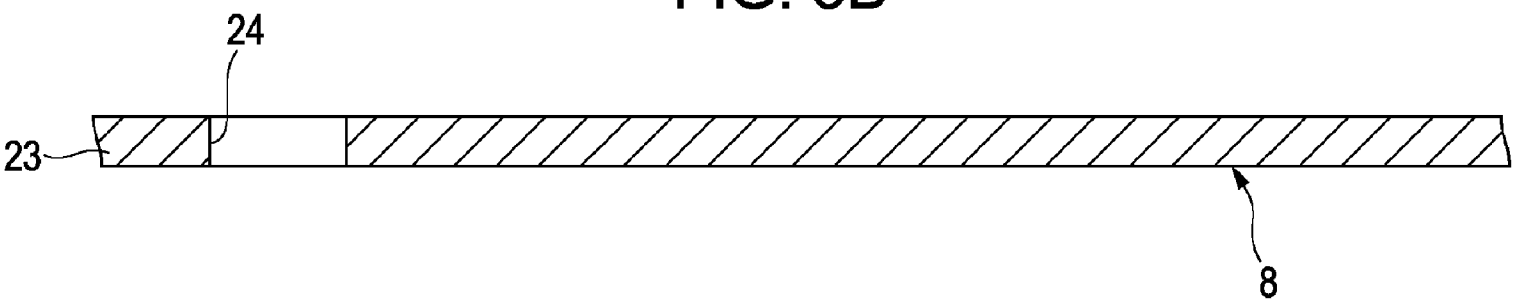
FIG. 3B is a central vertical sectional view of FIG. 3A.

The surface modification sheet 8 modifies a surface state of the protective layer that protects an image formed on the recording sheet 1. As shown in FIG. 3, a print open portion 24 and surface modification portions 25*a*, 25*b*, and 25*c* are formed side by side on a ribbon base sheet 23 in a longitudinal direction of the base sheet 23. The print open portion 24 is provided so as to allow the thermal transfer sheet 5 to directly contact the surface of the recording sheet 1. The surface modification portions 25*a*, 25*b*, and 25*c* are provided for modifying the surface state of the protective layer that protects an image formed on the recording sheet 1.

The base sheet 23 is itself a surface modification member for modifying the surface state of the protective layer that protects an image formed on the recording sheet 1, and is formed in the form of a ribbon having a predetermined length. The base sheet 23 is formed of a resin film having heat resistance near a glass transition temperature (Tg) of the protective layer 14 of the thermal transfer sheet 5. The resin film may be, for example, a polyimide film. More specifically, a polyimide film called Upilex-S (trade name, produced by Ube Industries, Ltd.) having a thickness on the order of 25 μm. Since the surface of the polyimide film is very smooth, the surface state of the protective layer of an image formed on the recording sheet 1 becomes a smooth state in accordance with the surface state of the polyimide film.

It is desirable that the surface modification portions 25*a*, 25*b*, and 25*c* on the base sheet 23 be subjected to a peel-type processing so that they do not adhere to the surface of the protective layer (which protects an image formed on the recording sheet 1) near the glass transition temperature (Tg) of the protective layer 14 of the thermal transfer sheet 5. Therefore, when the surface modification sheet 8 is peeled after a surface modification processing of the protective layer of the image formed on the recording sheet 1, improper peeling occurring due to, for example, cohesive failure in the protective layer does not occur. Consequently, good interfacial peeling can be achieved at the boundary between the protective layer of the recording sheet 1 and the surface modification portions 25*a*, 25*b*, and 25*c*. Thus, the surface of the protective layer of the image formed on the recording sheet 1 after the surface modification processing is in a very good finished state.

The base sheet 23 is not limited to the aforementioned Upilex-S (trade name, produced by Ube Industries, Ltd.). Therefore, for example, super engineering plastic material having sufficient heat resistance under a surface modification processing temperature such as other polyimides, including Kapton (trade name, produced by Du Pont), polysulfone, polyetherimide, or polyethylene terephthalate (PET); or an engineering plastic material may be used.

The print open portion 24 allows the thermal transfer sheet 5 to directly contact the surface of the recording sheet 1 when forming an image onto the recording sheet 1. The planar shape of the print open portion 24 is, for example, a rectangular shape. A width W (see FIG. 3A) of the print open portion 24 extending in a widthwise direction of the base sheet 23 is slightly larger than a main-scanning direction length of the thermal head (that is, a direction perpendicular to a sheet plane of FIG. 1). A length L (see FIG. 3A) of the print open portion 24 extending in the longitudinal direction of the base sheet 23 is slightly larger than a subscanning-direction width of the thermal head 11 (that is, a direction parallel to the sheet plane of FIG. 1). Therefore, when an ordinary printing operation or an ordinary protective layer forming operation are performed on the recording sheet 1, the thermal head 11 is pushed against the printing sheet 1 through the thermal transfer sheet 5. While moving the print sheet 1 and the thermal transfer sheet 5, the thermal head 11 is used to form an image, to further perform a printing operation that forms the protective layer on the image.

The width W and the length L of the print open portion 24 may not be larger than the main-scanning direction length and the subscanning direction width of the thermal head 11, respectively. For example, at least the width W and the length L may be larger than a printing-heater (not shown) formation portion of the thermal head 11 and an area where a protruding glaze 26 is formed in the vicinity thereof, respectively.

The surface modification portions 25*a*, 25*b*, and 25*c* modify the surface state of the protective layer that protects an image formed on the recording sheet 1. For example, a plurality of types of surface modification portions for modifying surface states of protective layers to different surface states may be sequentially formed adjacent to the print open portion 24. For example, the first surface modification portion 25*a* is one for a glossiness finishing operation that provides glossiness, the second surface modification portion 25*b* is one for a mat-tone finishing operation, and the third surface modification portion 25*c* is one for a mat-tone finishing operation providing a different texture. The number of types of surface states for modification and the order of arrangement of the surface modification portions are not limited to those mentioned above. For example, only one surface modification portion may be provided, or only those used for glossiness finishing operations may be disposed at a plurality of locations in accordance with a prediction of how frequently surface modification portions are used in a surface modification processing operation of the protective layer of an image formed on the recording sheet 1.

In FIG. 3, symbol 27*a* denotes a leading position of the first surface modification portion 25*a*, and symbol 28*a* denotes a rear position of the surface modification portion 25*a*. Symbol 27*b* denotes a leading position of the second modification portion 25*b*, and symbol 28*b* denotes a rear position of the surface modification portion 25*b*. Symbol 27*c* denotes a leading position of the third surface modification portion 25*c*, and symbol 28*c* denotes a rear position of the third surface modification portion 25*c*.

In addition, in FIG. 3, symbol 29 denotes an open-portion position detection mark disposed near the print open portion 24 and used for detecting the leading position of the print open portion 24. Symbol 30*a* denotes a modification-portion position detection mark disposed near the surface modification portion 25*a* and used for detecting the leading position of the first surface modification portion 25*a*. Symbol 30*b* denotes a modification-portion position detection mark disposed near the surface modification portion 25*b* and used for detecting the leading position of the second surface modification portion 25*b*. Symbol 30*c* denotes a modification-portion position detection mark disposed near the surface modification portion 25*c* and used for detecting the leading position of the third surface modification portion 25*c*.

The position detection marks 29, 30*a*, 30*b*, and 30*c* are marking holes that are through holes formed with predetermined sizes in the base sheet 23. Here, the open-portion position detection mark 29 has two marking holes, and the modification-portion position detection marks 30*a*, 30*b*, and 30*c* each have one marking hole. The locations of the marking holes of the marks 30*a*, 30*b*, and 30*c* are not situated at corresponding locations to distinguish among the marks 30*a*, 30*b*, and 30*c*.

As shown in FIG. 1, the surface modification sheet 8 having such a structure is tightly stretched between the supply reel 9 and the take-up reel 10, and is removable in the body of the apparatus. When the surface modification sheet 8 that is tightly stretched between the supply reel 9 and the take-up reel 10 is mounted in the body of the apparatus, the surface modification sheet 8, along with the thermal transfer sheet 5, is nipped between the platen roller 2 and the thermal head 11, and moves in the directions of arrows D and E in synchronism with the conveyance of the recording sheet 1. Here, the supply reel 9 and the take-up reel 10 constitute a modification sheet moving unit that moves the surface modification sheet 8.

A mechanical sensor 31 is provided in a movement path of the surface modification sheet 8 moved by the modification sheet moving unit. The mechanical sensor 31 is a detecting unit that detects the various position detection marks 29, 30*a*, 30*b*, and 30*c* of the surface modification sheet 8. As shown in FIG. 1, the light sensor 31 is disposed at a position that is separated by a predetermined distance from the thermal head 11 in the movement direction indicated by the arrow D when printing onto the recording sheet 1. Therefore, when the various position detection marks 29, 30*a*, 30*b*, and 30*c* are detected, the positions of the print open portion 24 and the first surface modification portion 25*a*, the second surface modification portion 25*b*, and the third surface modification portion 25*c*, shown in FIG. 3, are aligned with a recording portion of the thermal head 11.

Figure 4:
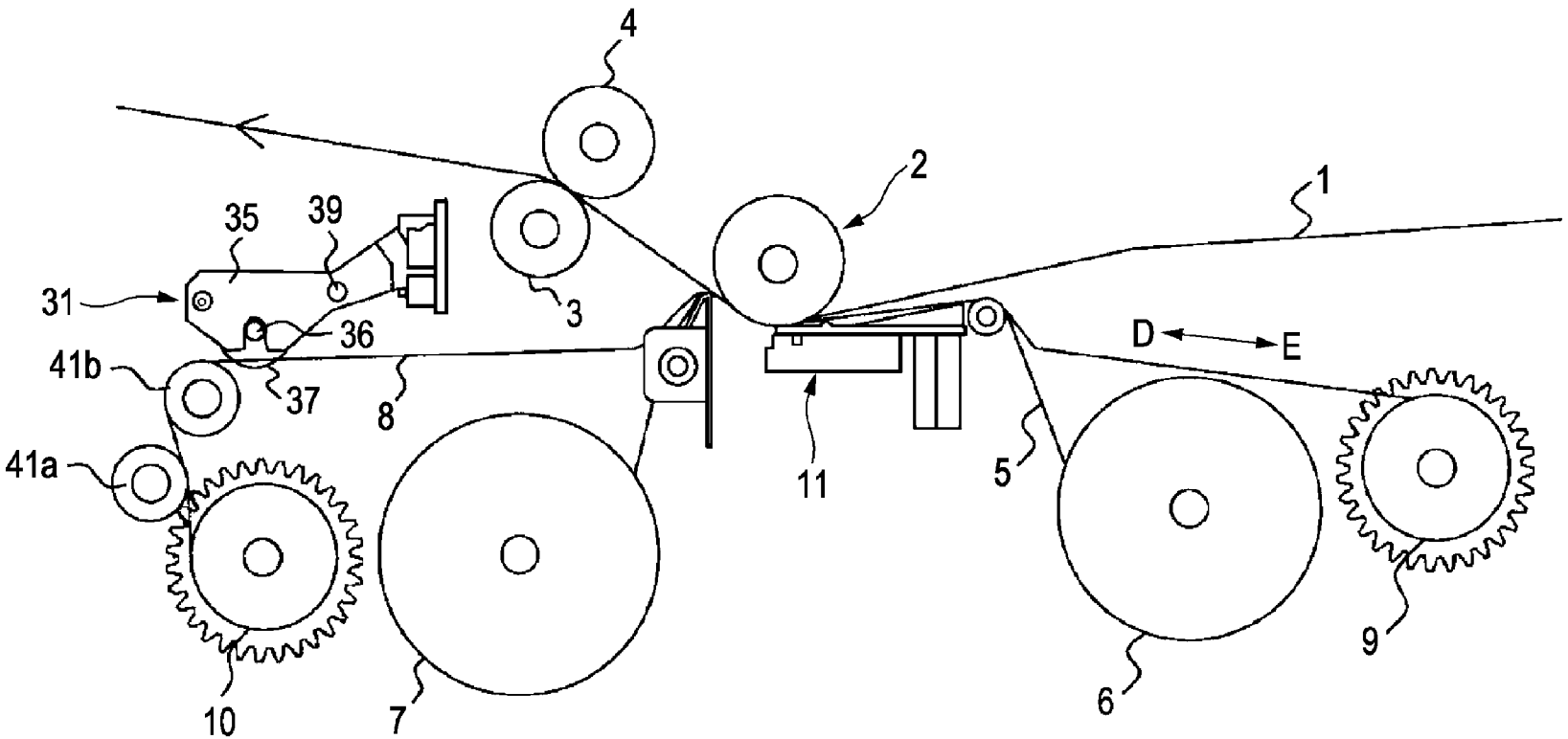
FIG. 4 is a structural view showing a specific mechanism corresponding to the image forming apparatus shown in FIG. 1.

A specific structure and operation of the mechanical sensor 31 will be described with reference to FIGS. 4 to 6. FIG. 4 is a structural view showing a specific mechanism corresponding to the image forming apparatus shown in FIG. 1. In FIG. 4, corresponding parts to those shown in FIG. 1 are given the same reference numerals. The mechanical sensor 31 is mounted to a sensor substrate 35 mounted to, for example, a housing (not shown) of the thermal printer. A roller 37, which is supported at a support shaft 36, is rotatably provided at an end where the mechanical sensor 31 contacts the surface of the surface modification sheet 8.

Figure 5A:
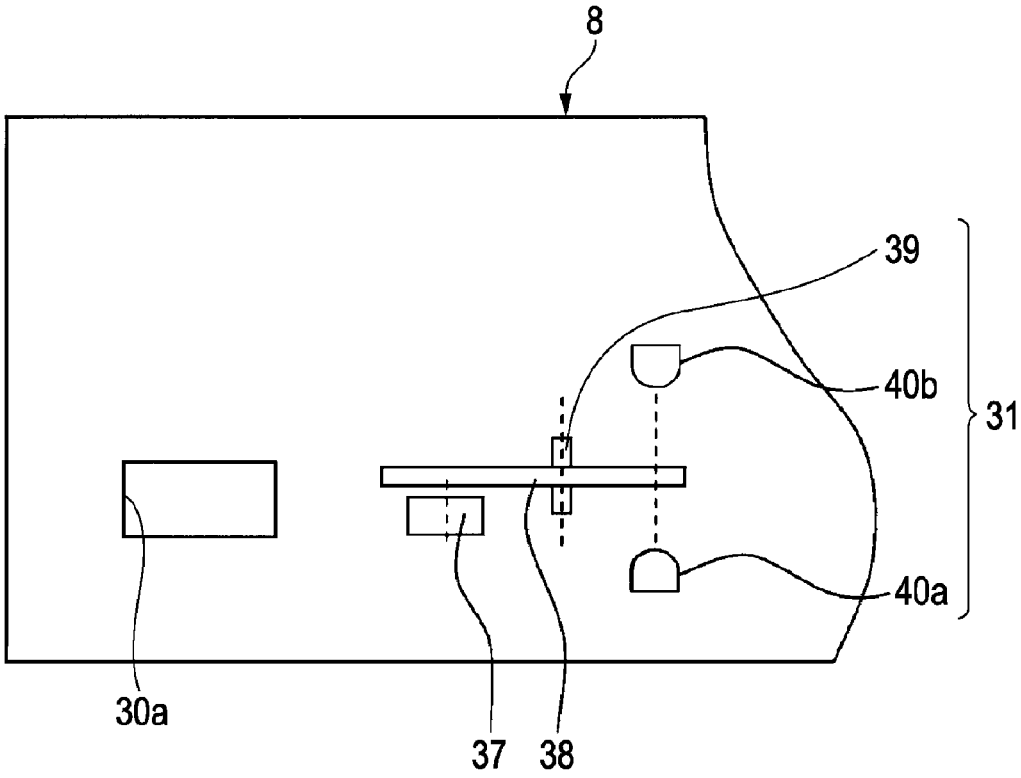
FIGS. 5A and 5B are, respectively, a top view and a front view of an internal structure of a mechanical sensor mounted to a sensor substrate shown in FIG. 4.
Figure 5B:
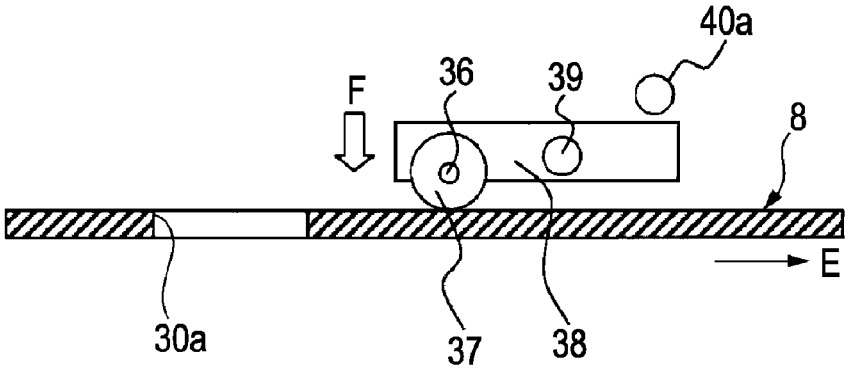
Figure 6A:
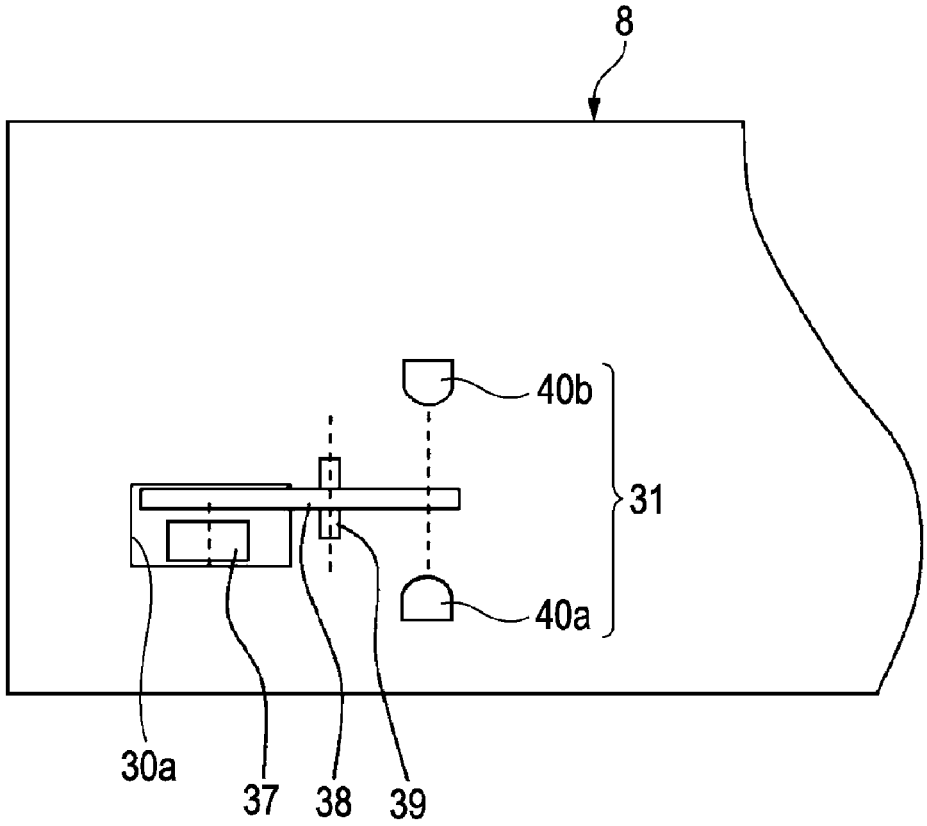
FIGS. 6A and 6B are, respectively, a top view and a front view of the operation of the mechanical sensor having the structure shown in FIGS. 5A and 5B.

FIGS. 5A and 5B are, respectively, a top view and a front view of an internal structure of the mechanical sensor 31 mounted to the sensor substrate 35. For example, an actuator 38, in the form of an elongated plate, is swingably supported at the sensor substrate 35 by a support shaft 39. The support shaft 39 is shifted towards once side. The roller 37, which is supported by the support shaft 36, is rotatably provided at one end, such as a left end, of the actuator 38 so as to follow the movement of the surface modification sheet 8. In this case, as shown in FIG. 5A, the actuator 38 and the roller 37 are provided so as to be positioned in a path that the modification-portion position detection marks 30*a*, 30*b*, and 30*c* (provided on the surface modification sheet 8) pass as the surface modification sheet 8 moves. As shown in FIG. 5B, since the support shaft 39 supports the actuator 38 while the support shaft 39 is shifted towards the right side of the actuator 38, the left end of the actuator 38 is biased downward by a force F due to a balance between the self weight of the actuator 38 and the self weight of the roller 37. The biasing force has a magnitude that does not deform the surface modification sheet 8. If necessary, the actuator 38 may be biased by adding a spring having a proper strength.

As shown in FIG. 5A, a light-emitting portion (such as a light-emitting diode) 40*a* and a light-receiving portion (such as a photosensor) 40*b* are provided at respect sides of the other end (such as the right end) of the actuator 38. In addition, for example, the right end of the actuator 38 swings and blocks a light axis connecting the light-emitting portion 40*a* and the light-receiving portion 40*b*. In this state, the actuator 38, the roller 37, the light-emitting portion 40*a*, and the light-receiving portion 40*b* constitute the mechanical sensor 31.

Next, the operation of the mechanical sensor 31 having such a structure will be described with reference to FIGS. 5A and 5B and FIGS. 6A and 6B. FIG. 5A shows a state prior to detecting the modification-portion position detection mark 30*a* for detecting the leading position of the first surface modification portion 25*a* of the surface modification sheet 8 shown in FIG. 3. As the surface modification sheet 8 moves in the direction of arrow E, the roller 37 of the mechanical sensor 31 contacts the surface of the surface modification sheet 8, and is driven and rotated. At this time, as shown in FIG. 5B, for example, the right end of the actuator 38 does not swing, so that it does not block the light axis connecting the light-emitting portion 40*a* and the light-receiving portion 40*b*.

Figure 6B:
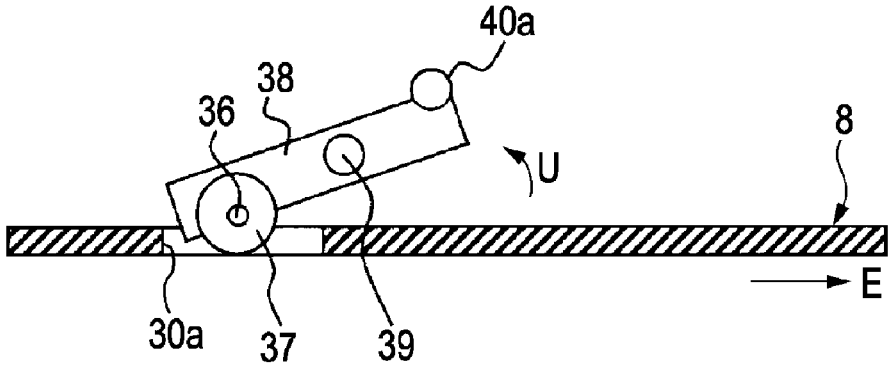

As shown in FIG. 6B, when the modification-portion position detection mark 30*a* moves to the position of the roller 37 of the mechanical sensor 31 as the surface modification sheet 8 moves in the direction of arrow E, the biasing force F shown in FIG. 5B causes the roller 37 to fall into the marking hole serving as the modification-portion position detection mark 30*a*. This causes the right end of the actuator 38 to swing upward as indicated by an arrow U, to block the light axis (shown in FIG. 6A) connecting the light-emitting portion 40*a* and the light-receiving portion 40*b*. Therefore, a detection is made that the modification-portion position detection mark 30*a* has moved to the position of the mechanical sensor 31, thereby making it possible to detect the leading position of the first surface modification portion 25*a* of the surface modification sheet 8.

The combination of the position detection marks 29, 30*a*, 30*b*, and 30*c* and the mechanical sensor 31 is provided with a function for detecting the positions corresponding thereto. Accordingly, any other combination may be used as long as it is provided with such a function. For example, in another combination, the position detection marks 29, 30*a*, 30*b*, and 30*c* may be light-intercepting marks, instead of being through holes, printed on the surface of the base sheet, and the mechanical sensor 31 may be replaced by a light-transmission sensor. Alternatively, a combination of light-intercepting marks and a reflection sensor or a reflection plate may be used. When the base sheet 23 has a high light-shielding effect, a combination of through holes and a light-transmission sensor may be used.

Figure 7A:
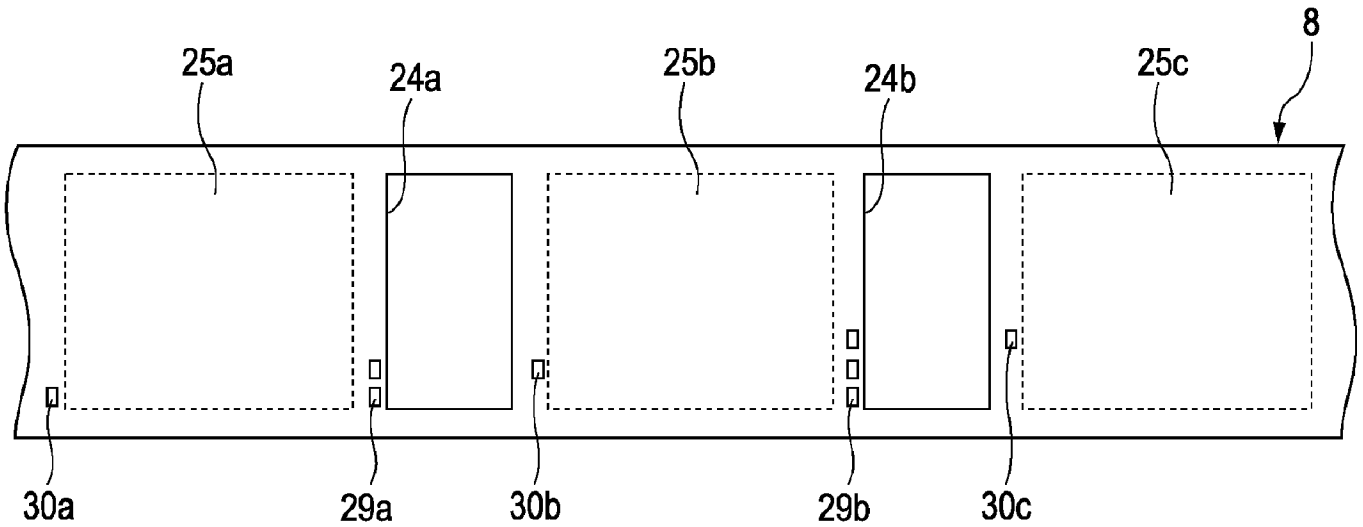
FIG. 7A is a plan view of another exemplary surface modification sheet.
Figure 7B:
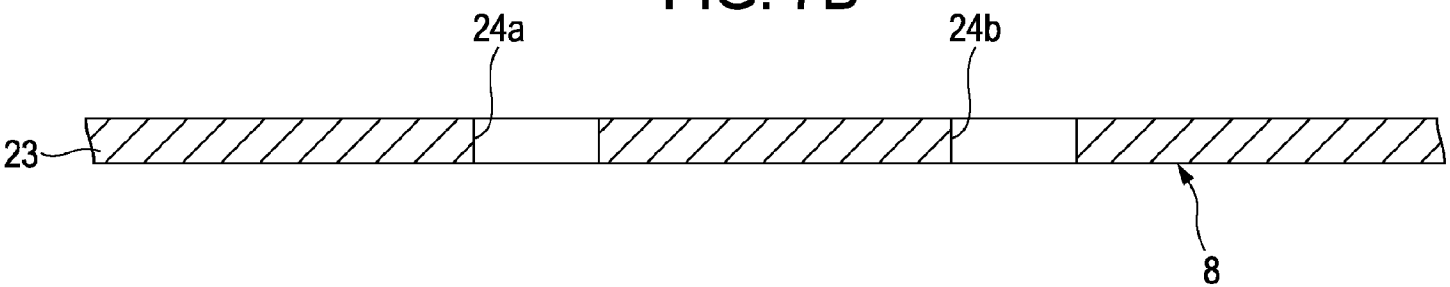
FIG. 7B is a central vertical sectional view of FIG. 7A.

FIGS. 7A and 7B show another exemplary surface modification sheet 8. In this example, a plurality of print open portions 24*a* and 24*b* are provided between surface modification portions 25*a*, 25*b*, and 25*c*. In FIG. 7A, the surface modification portions and the print open portions are alternatively disposed, that is, the first print open portion 24*a* is adjacent to the surface modification portion 25*a* or 25*b*, and the second print open portion 24*b* is adjacent to the surface modification portion 25*b* or 25*c*. In FIG. 7A, symbol 29*a* denotes an open-portion position detection mark (two marking holes) provided near the print open portion 24*a* and used for detecting a leading position of the first print open portion 24*a*, and symbol 29*b* denotes an open-portion position detection mark (three marking holes) provided near the print open portion 24*b* and used for detecting a leading position of the second print open portion 24*b*.

In this example, when printing is performed on the recording sheet 1, an appropriate print open portion can be selected from the print open portions 24*a* and 24*b* in accordance with the type of modification of the surface state of an image formed on the recording sheet 1. For example, in printing a plurality of images, when the type of modification of the surface state is a mat-tone finishing operation (25*c*) that provides a different texture and that is successively performed, the third surface modification portion 25*c* is used to perform the surface modification operation on a first sheet to be subjected to a mat-tone finishing operation providing a different texture. Then, when a next printing operation is performed, if the second print open portion 24*b* adjacent to the third surface modification portion 25*c* is selected to print an image, the amount of movement of the surface modification sheet 8 is reduced, so that this operation is efficient in terms of time.

Even in this example, a mechanical sensor 31 is disposed in a movement path of the surface modification sheet 8 moved by a modification sheet moving unit. A specific structure and operation of the mechanical sensor 31 are similar to those described with reference to FIGS. 4 to 6.

Although in each of the examples shown in FIGS. 3 and 7, the surface modification sheet 8 is described as having a single base sheet 23, the surface modification sheet 8 is not limited thereto. Therefore, if necessary, a reinforcing member may be used to reinforce the base sheet 23. For example, a metallic reinforcing layer may be provided at portions other than where the print open portions 24 are formed and where a heater of the thermal head 11 contacts the surface modification portions 25*a*, 25*b*, and 25*c* through the thermal transfer sheet 5. Alternatively, these portions of the base sheet 23 may partly be made thick.

In FIG. 1, while the dye layers 13 or the protective layer 14 of the thermal transfer sheet 5 opposes the surface of the recording sheet 1, the thermal head 11 applies thermal energy to thermally transfer sequentially the dye layers 13 and the protective layer 14 onto the recording sheet 1. The thermal head 11 has a plurality of heating elements disposed side by side in a straight line in a direction substantially perpendicular to the travel direction of the thermal transfer sheet 5 (direction of arrow C). On the basis of input image data, the thermal head 11 individually drives the heating elements to generate thermal energy, so that the dye layers 13*y*, 13*m*, and 13*c* and the protective layer 14 of the thermal transfer sheet 5 are heated by the thermal energy.

The thermal head 11 is driven by a head driving mechanism (not shown) so as to be moved in the directions of arrows J and K in FIG. 1. Here, during printing, the thermal head 11 moves forward in the direction of arrow J to lift the thermal transfer sheet 5 from the back surface thereof, and presses the thermal transfer sheet 5 and the recording sheet, conveyed along the outer peripheral surface of the platen roller 2, against the platen roller 2. When waiting or when the recording sheet 1 is rewound towards the upstream side in the opposite direction B, the thermal head 11 retreats in the direction of arrow K.

A modification sheet protecting unit is disposed in the movement path of the surface modification sheet 8. The modification sheet protecting unit prevents adhesion of dust to the surface modification sheet 8 or eliminates adhesion of dust to the surface modification sheet 8. More specifically, as shown in FIG. 4, the cleaning rollers 41*a* and 41*b* are disposed in the movement path of the surface modification sheet 8. The cleaning rollers 41*a* and 41*b* serve as dust removing tools that remove dust adhered to the surface modification sheet 8 by contacting and rotating with respect to the surface modification sheet 8. The first cleaning roller 41*a* removes dust adhered to a transfer surface of the surface modification sheet 8. The second cleaning roller 41*b* removes dust adhered to the back surface of the surface modification sheet 8. The cleaning rollers 41*a* and 41*b* are formed of adhesive rubber, such as silicone rubber or Isobutylene-Isoprene Rubber.

The dust removing tools are not limited to the cleaning rollers 41*a* and 41*b*. For example, rotating brushes having bristles mounted around a rotating shaft, linear brushes that wipe off dust on the surface modification sheet 8, a rubber blade that wipes off dust on the surface modification sheet 8, or a cushion press-contact member (such as urethane foam) may also be used. In any of the cases, it is desirable that the hardness of the material does not scratch the surface modification sheet 8.

Instead of the dust removing tools, such as the cleaning rollers 41*a* and 41*b*, static electricity removing tools that allow static electricity generated at the surface modification sheet 8 to escape may be provided. Alternatively, instead of providing the dust removing tools or the static electricity removing tools, a protective cover that covers the vicinity of the movement path of the surface modification sheet 8 excluding a portion corresponding to the thermal head 11 may be provided. Still alternatively, it is possible to provide the dust removing tools and the static electricity removing tools in the movement path of the surface modification sheet 8, and the protective cover in the vicinity of the movement path of the surface modification sheet 8.

In the embodiment of the present invention, after forming an image onto the recording sheet 1 using the thermal transfer sheet 5, and forming the protective layer that protects the image, the surface modification portion 25*a*, 25*b*, or 25*c* of the surface modification sheet 8 is aligned with a plane where the protective layer is formed to apply heat and pressure by the thermal head 11. This modifies the surface state of the protective layer formed on the recording sheet 1. For example, the surface state of the protective layer formed on the recording sheet 1 may be provided with glossiness, or may be finished to a mat tone state.

Next, the operation of the image forming apparatus having the above-described structure will be described. First, in FIG. 1, the roller driving mechanism (not shown) drives the platen roller 2, the pinch roller 3, and the capstan roller 4 to convey the recording sheet 1 in a predetermined direction. By this, a position where formation of an image on the recording sheet 1 is started is determined. At this time, in an initial state, a modification-sheet traveling unit including the supply reel 9 and the take-up reel 10 causes the surface modification sheet 8 to travel in a predetermined direction, to set the print open portion 24 (shown in FIG. 3 and FIG. 7) at a recording portion of the thermal head 11 where the printing heater and the glaze 26 (disposed in the vicinity of the printing heater) are formed.

Next, the operation of the thermal-transfer-sheet traveling unit including the supply reel 6 and the take-up reel 7 causes the thermal transfer sheet 5 to travel in the direction of arrow C. This causes a region of any one of the dye layers 13*y*, 13*m*, and 13*c* of the thermal transfer sheet 5 shown in FIG. 2 to match the location of the recording sheet 1 where an image is to be formed. At this time, the light sensor 22 shown in FIG. 1 detects the ink position detection marks 21*y*, 21*m*, and 21*c* of the thermal transfer sheet 5 to align the dye layer with the location of the recording sheet 1 where the image is to be formed.

Next, while the recording sheet 1 and any one of the dye layers 13*y*, 13*m*, and 13*c* of the thermal transfer sheet 5 oppose each other, the thermal head 11 is moved forward in the direction of arrow J. While the thermal transfer sheet 5 is pushed upward from its back surface and against the platen roller 2, thermal energy is applied by the thermal head 1, to thermally transfer the dye layer 13*y*, 13*m*, or 13*c* of the thermal transfer sheet 5 onto the front surface of the recording sheet 1, thereby forming the image. Accordingly, the image is formed onto the recording sheet 1 using the desired dye layer 13*y*, 13*m*, or 13*c*.

Figure 8A:
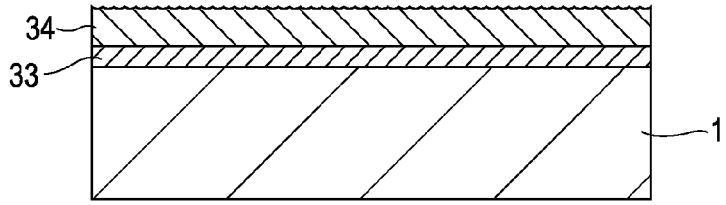
FIGS. 8A to 8D show a state in which a surface state of a protective layer is modified by aligning a surface modification portion of the surface modification sheet with the protective layer formed on an image of a recording sheet, when forming the image using the image forming apparatus.

Next, while the image formed on the recording sheet 1 and the protective layer 14 of the thermal transfer sheet 5 oppose each other, thermal energy is applied by the thermal head 11 to thermally transfer the protective layer 14 of the thermal transfer sheet 5 onto the image formed on the recording sheet 1. Here, as mentioned above, the operation of the thermal-transfer-sheet traveling unit causes the thermal transfer sheet 5 to travel in the direction of arrow C at the same time that the position of the protective layer 14 is aligned with the position of the image, formed on the recording sheet 1, by detecting the ink position detection marks 21*y*, 21*m*, 21*c*, and the protective layer position detection mark 21L of the thermal transfer sheet 5 with the optical sensor 22. By thermally transferring the protective layer 14, as shown in FIG. 8A, a protective layer 34 is formed on the surface of an image 33 formed on the surface of the recording sheet 1. In this state, the surface state of the protective layer 34 is not modified, as a result of which the surface of the protective layer 34 does not have sufficient glossiness.

Immediately after the protective layer 34 is formed on the surface of the image 33 on the recording sheet 1, the rear position 19L after the protective layer 14 of the thermal transfer sheet 5 shown in FIG. 2 has been transferred is at a recording portion of the thermal head 11 shown in FIG. 1. Therefore, the thermal transfer sheet 5 is rewound to the position prior to the transfer of the protective layer 14, that is, to the leading position 18L, by the operation of the thermal-transfer-sheet traveling unit. The print open portion 24 of the surface modification sheet 8 shown in FIG. 3 is positioned at the recording portion of the thermal head 11.

Next, the operation of the modification sheet moving unit including the supply reel 9 and the take-up reel 10 causes the surface modification sheet 8 to travel in the direction of arrow D or arrow E. Here, as shown in FIG. 4, for example, when the surface modification sheet 8 that is taken up by the take-up reel 10 is moved so as to be unwound in the direction of arrow E, the cleaning rollers 41*a* and 41*b*, provided in a movement path immediately following the take-up reel 10, contact and rotate with respect to the surface modification sheet 8, so that it is possible to remove dust adhered to the transfer surface and the back surface of the surface modification sheet 8.

Figure 8B:
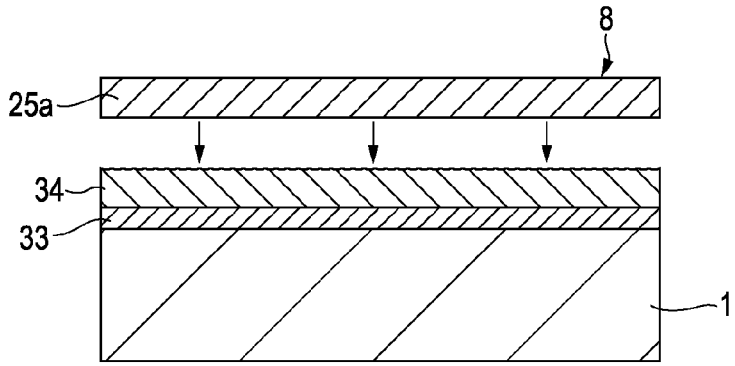

Thereafter, the protective layer 34, formed on the image 33 on the recording sheet 1 shown in FIG. 8A, is aligned with any one of the surface modification portions 25*a*, 25*b*, and 25*c* of the surface modification sheet 8, to apply heat and pressure by the thermal head 11, so that, after cooling, the surface modification sheet 8 is peeled off to modify the surface state of the protective layer. That is, as shown in FIG. 8B, for example, the first surface modification portion 25*a* (for a glossiness finishing operation) of the surface modification sheet 8 shown in FIG. 3 is selected and aligned with the protective layer 34 formed on the surface of the image 33 on the recording sheet 1. At this time, the mechanical sensor 31 shown in FIGS. 1 and 4 detects the various position detection marks 29, 30*a*, 30*b*, and 30*c* of the surface modification sheet 8 for aligning the first surface modification portion 25*a*.

Figure 8C:
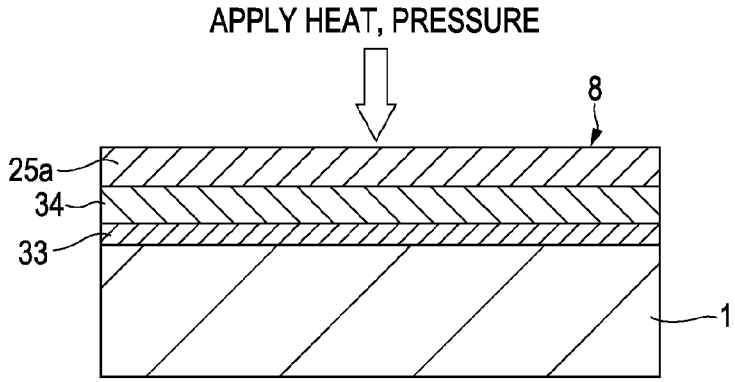

In this state, the position of the transferred protective layer 14 (not shown) of the thermal transfer sheet 5, the first surface modification portion 25*a* of the surface modification sheet 8, and the position where the protective layer 34 is formed on the image 33 on the recording sheet 1 overlap each other. With respect to this, the thermal head 11 shown in FIG. 1 is moved forward in the direction of arrow J; and, as shown in FIG. 8C, similarly to when normal printing is performed, pressure is applied by the thermal head 11 and the platen roller 2. Accordingly, with the thermal transfer sheet 5, the surface modification sheet 8, and the recording sheet 1 being heated to a temperature on the order of from 70 to 120° C., surface modification is performed while moving the thermal transfer sheet 5, the surface modification sheet 8, and the recording sheet 1.

Figure 8D:
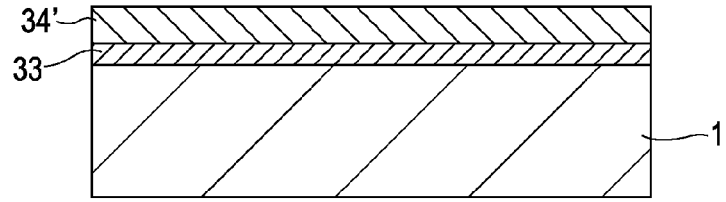

After the surface modification, the platen roller 2 rotates, and the thermal transfer sheet 5, the surface modification sheet 8, and the recording sheet 1 move downstream and separate from the thermal head 11. With the surface modification sheet 8 being cooled as a result of a reduction in the temperature, the surface modification sheet 8 is peeled off from the recording sheet 1. Therefore, as shown in FIG. 8D, the surface state of the protective layer 34 shown in FIG. 8A is modified, so that, for example, a printed material having a glossy protective layer 34' is obtained.

In the description with reference to FIGS. 8A to 8D, the region on the thermal transfer sheet 5 that is used in the surface modification corresponds to a region of the protective layer 14 that has been transferred. However, the region on the thermal transfer sheet 5 is not limited thereto. Regions of transferred or untransferred dye layers 13*y*, 13*m*, and 13*c* of the various colors (yellow (Y), magenta (M), and cyan (C)) may also be used. Even if the regions of transferred or untransferred dye layers 13*y*, 13*m*, and 13*c* are used, the thermal transfer sheet 5 is rewound to the positions prior to transferring the dye layers 13*y*, 13*m*, and 13*c*, that is, to the leading positions 18*y*, 18*m*, and 18*c* of the respective dye layers by the operation of the thermal-transfer-sheet traveling unit as mentioned above. In this case, even if ink remains at the dye layers 13*y*, 13*m*, and 13*c*, the ink is transferred to the back surface of the surface modification sheet 8, but is not transferred to the recording sheet 1 due to the existence of the surface modification sheet 8.

Figure 9A:
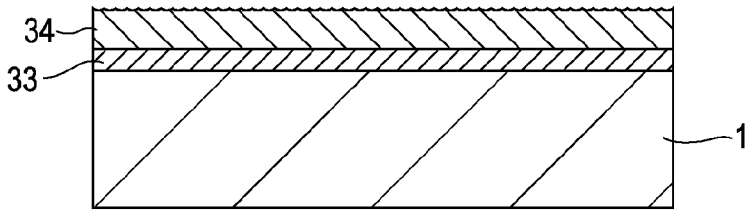
FIGS. 9A to 9D show another state in which the surface state of the protective layer is modified by aligning the surface modification portion of the surface modification sheet with the protective layer formed on the image of the recording sheet.
Figure 9B:
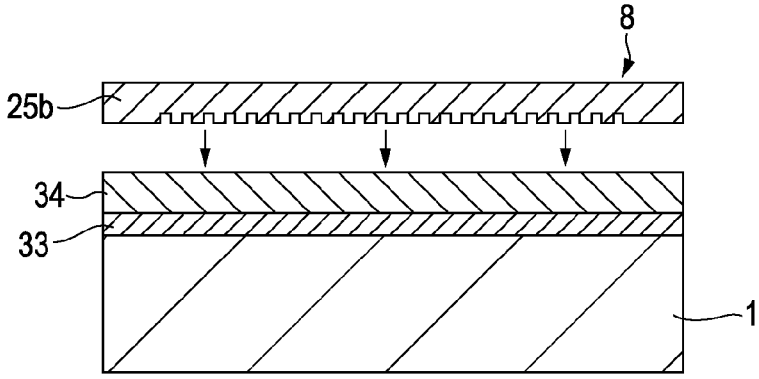

FIGS. 9A to 9D show another state in which the surface state of the protective layer 34 is modified by aligning the surface modification portion of the surface modification sheet 8 with the protective layer 34 formed on the image 33 of the recording sheet 1. In this state, the surface state of the protective layer 34 is finished to a mat tone state. The operation in FIG. 9A is exactly the same as that in FIG. 8A. In FIG. 9B, for example, the second surface modification portion 25*b* (for a mat-tone finishing operation) of the surface modification sheet 8 shown in FIG. 3 is selected and aligned with the position of the protective layer 34 formed on the surface of the image 33 on the recording sheet 1. Here, the mechanical sensor 31 shown in FIG. 1 detects the various position detection marks 29, 30*a*, 30*b*, and 30*c* of the surface modification sheet 8 for aligning the second surface modification portion 25*b*.

Figure 9C:
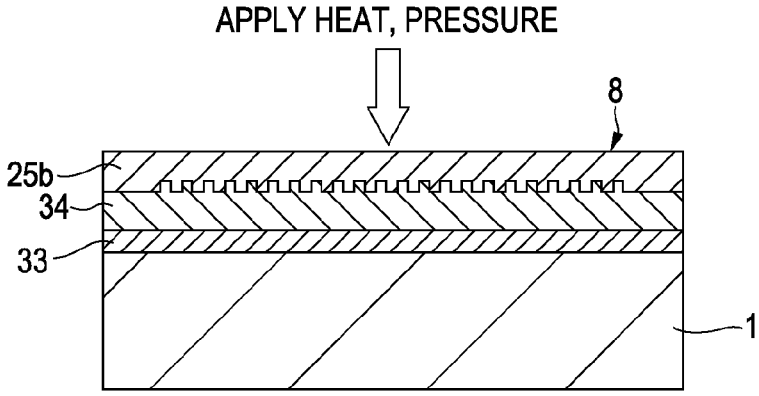

Next, in FIG. 9C, the position of the transferred protective layer 14 (not shown) of the thermal transfer sheet 5, the second surface modification portion 25*b* of the surface modification sheet 8, and the position where the protective layer 34 is formed on the image 33 on the recording sheet 1 overlap each other. With respect to this, the thermal head 11 shown in FIG. 1 is moved forward in the direction of arrow J; and, similarly to when normal printing is performed, pressure is applied by the thermal head 11 and the platen roller 2. Accordingly, with the thermal transfer sheet 5, the surface modification sheet 8, and the recording sheet 1 being heated to a temperature on the order of from 70 to 120° C., surface modification is performed while moving the thermal transfer sheet 5, the surface modification sheet 8, and the recording sheet 1.

Figure 9D:
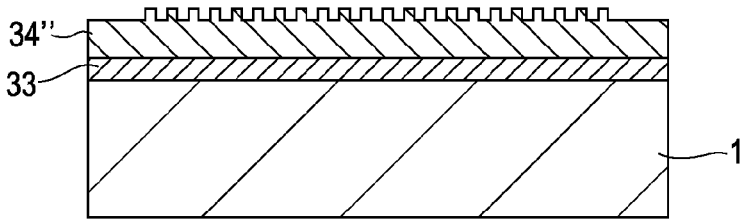

In FIG. 9D, after the surface modification, the platen roller 2 rotates, and the thermal transfer sheet 5, the surface modification sheet 8, and the recording sheet 1 move downstream and separate from the thermal head 11. With the surface modification sheet 8 being cooled as a result of a reduction in the temperature, the surface modification sheet 8 is peeled off from the recording sheet 1. Therefore, the surface state of the protective layer 34 shown in FIG. 9A is modified, so that, for example, a printed material having a protective layer 34" that is finished to a mat tone state is obtained.

In the examples shown in FIGS. 8 and 9, the case in which one image 33 is printed and the surface state of the protective layer 34 of the image 33 is modified is described. However, even if a plurality of images 33 are successively printed to mix surface modification states of various printed materials, the surface state of the protective layer 34 can be modified by successive operations. Here, for simplifying the explanation, the case in which a first printed material is finished to a glossy state, and a second printed material is finished to a mat tone state to modify a surface state will be described.

First, after forming a first image 33 and the protective layer 34 by the same operations as those illustrated in FIG. 8, successive operations are performed to perform surface modification using the first surface modification portion 25*a* (for a glossy finishing operation) of the surface modification sheet 8. As a result, a first printed material having increased glossiness is obtained.

Next, as with operations performed during normal successive printing, the thermal transfer sheet 5 is conveyed so that the leading position 18*y* of the dye layer 13 within the structural unit corresponding a second image in the thermal transfer sheet 5 shown in FIG. 2 is positioned at the recording portion of the thermal head 11. Then, the surface modification sheet 8 is moved so that the print open portion 24 is positioned at the recording portion of the thermal head 11. In this state, the second image 33 and the protective layer 34 are formed.

At this time, since the rear position 19L after the protective layer 14 of the thermal transfer sheet 5 shown in FIG. 2 has been transferred is positioned at the recording portion of the thermal head 11 shown in FIG. 1, the thermal transfer sheet 5 is rewound to the position prior to transferring the protective layer 14, that is, to the leading positions 18L by the operation of the thermal-transfer-sheet traveling unit. Then, the surface modification sheet 8 is moved so that the leading position 27*b* of the second surface modification portion 25*b* for a mat-tone finishing operation is positioned at the recording portion of the thermal head 11. Next, as with the first image, successive operations are performed to perform surface modification using the second surface modification portion 25*b* of the surface modification sheet 8. As a result, a second printed material finished to a mat tone state is obtained.

In this way, according to the image forming apparatus according to the embodiment of the present invention, the formation of the image 33 on the recording sheet 1, the formation of the protective layer 34 above the recording sheet 1, and the modification of the surface state can all be successively performed. Therefore, when a plurality of images 33 are successively formed, even if surface modification states of respective printed materials are mixed, the surface state of the protective layer 34 can be modified by the successive operations.

In the examples shown in FIGS. 8 and 9, the following may be performed. That is, when the plurality of images 33 are successively printed and the surface state of the protective layer 34 is modified by successive operations, first, the protective layer 34 and the images 33 for the plurality printed materials are only formed. Then, the surface state of the protective layer 34 of the plurality of printed materials is successively modified in accordance with required surface states of the respective printed materials.

Although, in the foregoing description, what is called a sublimation transfer thermal printer is used as an example of the image forming apparatus, the image forming apparatus is not limited thereto, so that the image forming apparatus may be a fusion transfer thermal printer. The present invention is applicable to modifying a surface state of a printed material in a thermal printer that performs recording on a thermosensitive recording sheet without using a thermal transfer sheet.

Figure 10:
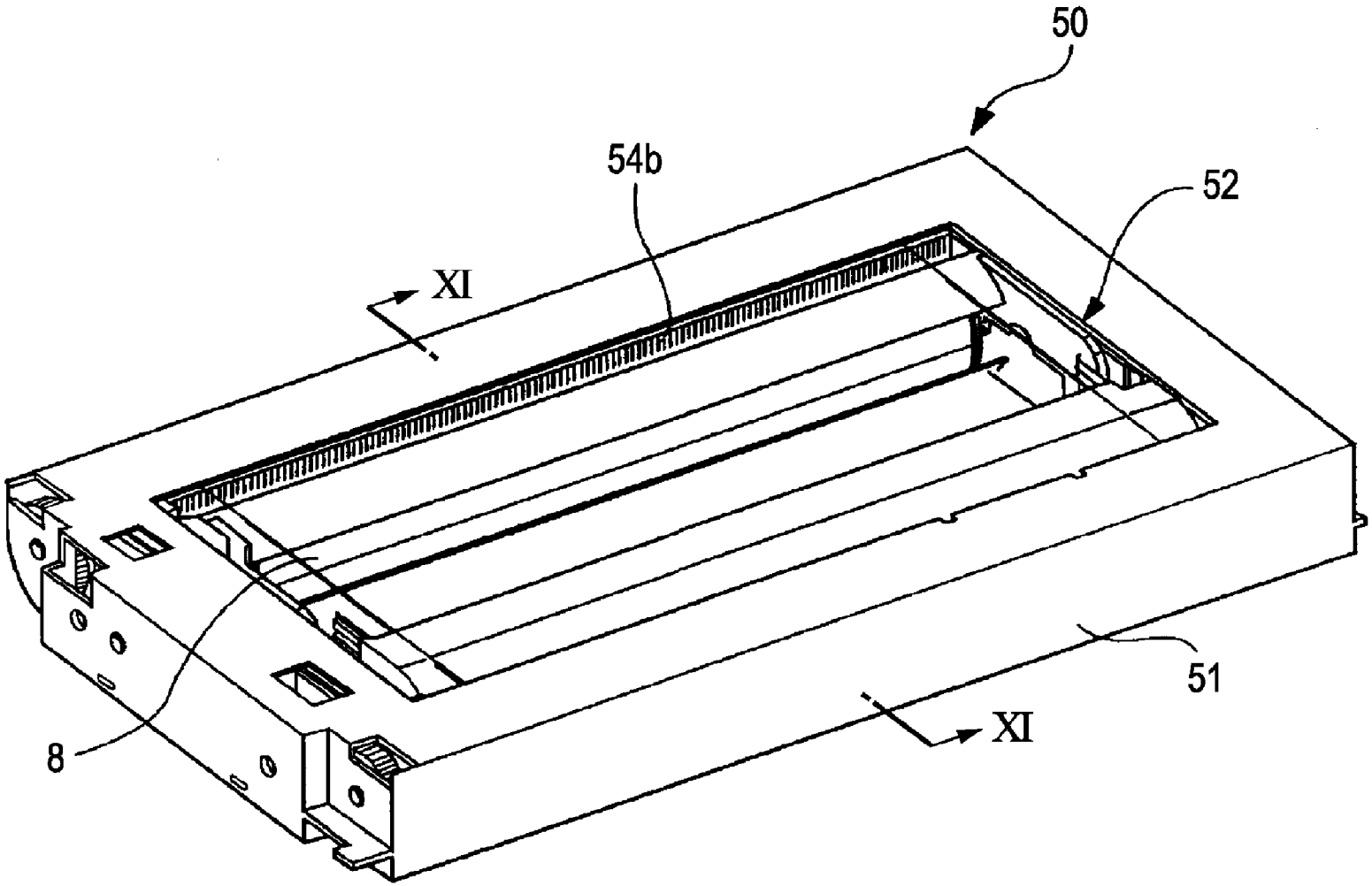
FIG. 10 is a perspective view of a modification sheet cartridge according to an embodiment used in the image forming apparatus.

FIG. 10 is a perspective view of a modification sheet cartridge according to an embodiment used in the image forming apparatus having the above-described structure. In a modification sheet cartridge 50, the surface modification sheet 8 placed between the supply reel 9 and the take-up reel 10 shown in FIGS. 1 and 4 is formed as a unit separately from the image forming apparatus, so that it is removable from the body of the image forming apparatus, and is easily handled when, for example, being conveyed or replaced. The modification sheet cartridge 50 has the supply reel 9 and the take-up reel 10 (see FIG. 11), a protective cover 51, and a modification-sheet dust processing unit (described later).

The protective cover 51 covers the vicinity of the movement path of the surface modification sheet 8 excluding a portion corresponding to the thermal head 11 shown in FIGS. 1 and 4, has an overall flat rectangular box-like form, and defines the contour of the modification sheet cartridge 50. A rectangular print window 52 used when the thermal head 11 shown in FIGS. 1 and 4 thermally transfers the dye layers or the protective layer of the thermal transfer sheet 5 onto the surface of the recording sheet 1 is formed in the top surface of the protective cover 51. A longitudinal length of the print window 52 is larger than a depth-direction width of the surface modification sheet 8 placed between the supply reel 9 and the take-up reel 10 shown in FIG. 11, and its short-side length perpendicular to the longitudinal direction of the print window 52 is smaller than an opposing distance between the supply reel 9 and the take-up reel 10 shown in FIG. 11.

Figure 11:
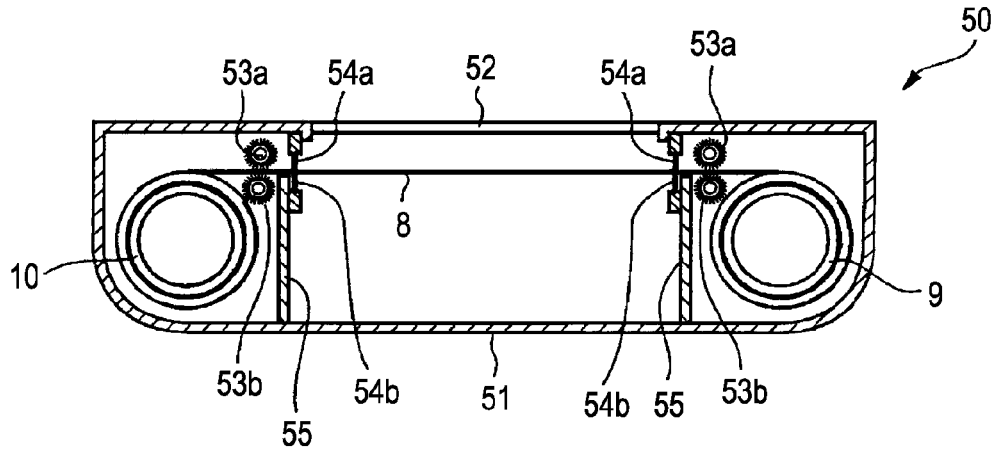
FIG. 11 is a sectional view taken along line XI-XI of FIG. 10.

As shown in FIG. 11, the supply reel 9 and the take-up reel 10 oppose each other and are separated by a predetermined distance from each other in the protective cover 51. The supply reel 9 has the surface modification sheet 8 previously wound thereupon. The surface modification sheet 8 is supplied to a portion corresponding to the thermal head 11 from the supply reel 9. In FIG. 11, the supply reel 9 is disposed, for example, at the right end of the protective cover 51 in the longitudinal direction thereof. The take-up reel 10 causes the surface modification sheet 8 wound upon the supply reel 9 to pass the portion corresponding to the thermal head 11 and takes up the surface modification sheet 8. In FIG. 11, the take-up reel 10 is disposed, for example, at the left end of the protective layer 51 in the longitudinal direction thereof. In such a state, the surface modification sheet 8 is placed between the supply reel 9 and the take-up reel 10 so that it can be taken up and rewound. The supply reel 9 and the take-up reel 10 are rotated in the forward direction and the opposite direction by a rotation driving source (not shown) provided at the body of the apparatus.

The modification sheet dust processing unit is provided in the movement path of the surface modification sheet 8 between the supply reel 9 and the take-up reel 10. The modification sheet dust processing unit removes dust adhered to the surface modification sheet 8, and includes dust removing tools that remove dust adhered to the surface modification sheet 8 and/or static electricity removing tools that allow static electricity generated at the surface modification sheet 8 to escape.

The dust removing tools may be rotating brushes 53*a* and 53*b* shown in FIG. 11, in addition to the cleaning rollers 41*a* and 41*b* shown in FIG. 4. Here, the first rotating brush 53*a* contacts and rotates with respect to the surface modification sheet 8 to remove dust adhered to the transfer surface of the surface modification sheet 8. The second rotating brush 53*b* contacts and rotates with respect to the surface modification sheet 8 to remove dust adhered to the back surface of the surface modification sheet 8. Here, it is desirable that the rotating brushes 53*a* and 53*b* be formed of a material having a hardness that does not scratch the surface modification sheet 8. A specific form of each of the rotating brushes 53*a* and 53*b* is one having bristles mounted around a linear rotating shaft.

The cleaning rollers 41*a* and 41*b* and the rotating brushes 53*a* and 53*b* contact the surface modification sheet 8, and are driven and rotated as the surface modification sheet 8 moves. Alternatively, using driving force of the rotation driving source of the supply reel 9 and the take-up reel 10, the cleaning rollers 41*a* and 41*b* and the rotating brushes 53*a* and 53*b* may be driven and rotated. In this case, the cleaning rollers 41*a* and 41*b* and the rotating brushes 53*a* and 53*b* may be rotated at a speed that is greater than or less than a movement speed of the surface modification sheet 8, or in opposite directions.

The dust removing tools are not limited to the aforementioned cleaning rollers 41 and 41*b* and rotating brushes 53*a* and 53*b*, so that they may be anything that removes dust, such as a linear brush or a rubber blade that wipes off dust on the surface modification sheet 8.

The static electric removing tools are, for example, electricity removing brushes 54*a* and 54*b* shown in FIG. 11. The electricity removing brushes 54*a* and 54*b* are used to allow the escape of static electricity resulting from accumulation of peel charge on the surface modification sheet. The peel charge is generated when the surface modification sheet 8 is separated from the recording sheet 1 after aligning the surface modification portion of the surface modification sheet 8 with the surface where the image is formed on the recording medium 1 and applying heat and pressure by the thermal head 11 for modifying the surface nature of the image formed on the recording sheet 1 shown in FIG. 1. Here, the first electricity removing brush 54*a* contacts the surface modification sheet 8 to allow static electricity generated at the transfer surface of the surface modification sheet 8 to escape. The second electricity removing brush 54*b* contacts the surface modification sheet 8 to allow static electricity generated at the back surface of the surface modification sheet 8 to escape. Here, it is desirable that the electricity removing brushes 54*a* and 54*b* be formed of a material having a hardness that does not scratch the surface modification sheet 8. The material may be, for example, stainless fiber. A specific form of each of the electricity removing brushes 54*a* and 54*b* is one having bristles formed of stainless fiber implanted along an elongated linear base member.

The static electricity removing tools are not limited to the aforementioned electricity removing brushes 54*a* and 54*b*, so that they may be anything that allows static electricity to escape, such as an electricity removing wire, an electricity removing roller, or an ion generating device for removing electricity.

In FIG. 11, reference numerals 55 denote partition plates that partition a driving area of the thermal head 11 that is positioned in the protective cover 51 and a waiting area of the surface modification sheet 8 taken up by the supply reel 9 or the take-up reel 10, when the modification sheet cartridge 50 is mounted to the body of the image forming apparatus. The partition plates 55 prevent dust around the thermal head 11 from adhering to the surface modification sheet 8 taken up by the supply reel 9 or the take-up reel 10.

Although, in FIG. 11, the rotating brushes 53*a* and 53*b* and the electricity removing brushes 54*a* and 54*b* are provided so as to be positioned at the respective sides of the supply reel 9 and the take-up reel 10, the present invention is not limited thereto. Only the rotating brushes 53*a* and 53*b* or only the electricity removing brushes 54*a* and 54*b* may be provided. Alternatively, the rotating brushes 53*a* and 53*b* or the electricity removing brushes 54*a* and 54*b* may be provided at only one side of the supply reel 9 or the take-up reel 10.

Figure 12:
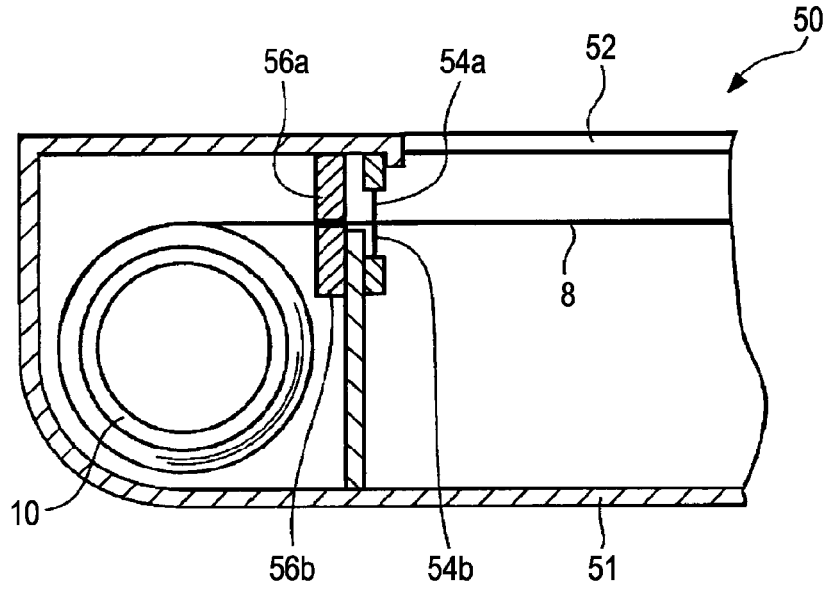
FIG. 12 is an enlarged sectional view of a main portion of other exemplary dust removing tools of the modification sheet cartridge.

FIG. 12 is an enlarged sectional view of a main portion of other exemplary dust removing tools of the modification sheet cartridge 50. In the example, the dust removing tools include wiper blades 56*a* that are formed of a cushion press-contact material (such as urethane foam) and that wipe off dust on the surface modification sheet 8. Here, the first wiper blade 56*a* contacts the surface modification sheet 8 to wipe off dust adhered to the transfer surface of the surface modification sheet 8. The second wiper blade 56*b* contacts the surface modification sheet 8 to wipe off dust adhered to the back surface of the surface modification sheet 8.

The modification sheet cartridge 50 having such a structure is removably mounted to a lower position of the platen roller 2 of the image forming apparatus in FIGS. 1 and 4. In addition, using the protective cover 51, the modification sheet cartridge 50 can prevent adhesion of dust to the surface modification sheet 8 placed between the supply reel 9 and the take-up reel 10 in the modification sheet cartridge 50. Further, using the cleaning rollers 41*a* and 40*b*, the rotating brushes 53*a* and 53*b*, or the wiper blades 56*a* and 56*b*, the modification sheet cartridge 50 can remove dust adhered to the surface modification sheet 8. Still further, using the electricity removing brushes 54*a* and 54*b*, the modification sheet cartridge 50 can prevent dust floating in the vicinity of the surface modification sheet 8 from adhering to the surface modification sheet 8 by allowing static electricity generated at the surface modification sheet 8 to escape. Therefore, in the image forming apparatus, it is possible to take measures against dust to improve the quality of the surface state of a printed material.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

conveying means for conveying a recording medium in a predetermined direction;

thermal transfer sheet traveling means for causing a thermal transfer sheet to travel in a predetermined direction, the thermal transfer sheet having a dye layer and a protective layer disposed side by side on a ribbon base sheet in a longitudinal direction of the base sheet, the dye layer being thermally transferred onto a surface of the recording medium to form an image thereon, the protective layer being thermally transferred onto a surface of the image formed on the surface of the recording medium to protect the image;

modification sheet moving means for moving a surface modification sheet, the surface modification sheet having a print open portion and a surface modification portion disposed side by side at a ribbon base sheet in a longitudinal direction of the base sheet, the print open portion being provided so as to allow the thermal transfer sheet to directly contact the surface of the recording medium, the surface modification portion being provided to modify a surface state of the protective layer that protects the image formed on the recording medium;

a thermal head that applies thermal energy and thermally transfers sequentially the dye layer and the protective layer onto the recording medium while the dye layer or the protective layer of the thermal transfer sheet opposes the surface of the recording medium; and modification sheet protecting means, disposed in a movement path of the surface modification sheet, for preventing adhesion of dust to the surface modification sheet or for eliminating the adhesion, wherein, after forming the image onto the recording medium using the thermal transfer sheet and forming the protective layer that protects the image, the surface modification portion of the surface modification sheet is aligned with a plane in which the protective layer is formed, so that heat and pressure are applied by the thermal head to modify the surface state of the protective layer formed at the recording medium.

2. The image forming apparatus according to claim 1, wherein the modification sheet protecting means includes a protective cover that covers a vicinity of the movement path of the surface modification sheet excluding a portion corresponding to the thermal head.

3. The image forming apparatus according to claim 1, wherein the modification sheet protecting means includes either one of or both of a dust removing tool and a static electricity removing tool, the dust removing tool removing the dust adhered to the surface modification sheet, the static electricity removing tool allowing static electricity generated at the surface modification sheet to escape.

4. The image forming apparatus according to claim 1, wherein:

the thermal transfer sheet has a plurality of the dye layers of one or a plurality of colors and the protective layer successively disposed on a surface of the ribbon base sheet, the thermal transfer sheet having position detection marks disposed near the respective dye layers and the protective layer, and the image forming apparatus includes detecting means for detecting the position detection marks in a travel path of the thermal transfer sheet.

5. The image forming apparatus according to claim 1, wherein:

the surface modification sheet has a plurality of the surface modification portions of one or a plurality of types successively disposed on a surface of the ribbon base sheet, the plurality of the surface modification portions being provided for modifying the surface state of the protective layer formed at the recording medium into one or different types of surface states, the surface modification sheet having position detection marks disposed near the print open portion and the respective surface modification portions, and the image forming apparatus includes detecting means for detecting the position detection marks in the movement path of the surface modification sheet.

6. The image forming apparatus according to claim 5, wherein the plurality of the surface modification portions of the surface modification sheet give glossiness to the surface state of the protective layer that protects the image formed on the recording medium.

7. The image forming apparatus according to claim 5, wherein the plurality of the surface modification portions of the surface modification sheet finish to a mat tone state the surface state of the protective layer that protects the image formed on the recording medium.

8. A modification sheet cartridge used in an image forming apparatus in which, after forming an image onto a recording medium using a thermal transfer sheet and forming a protective layer that protects the image, a surface modification portion, disposed at a surface modification sheet, for modifying a surface state of the protective layer is aligned with a plane in which the protective layer is formed, so that heat and pressure are applied by the thermal head to modify the surface state of the protective layer formed on the recording medium, the modification sheet cartridge comprising:

two reels upon which the surface modification sheet is placed so that the surface modification sheet is capable of being taken up and rewound, the two reels being disposed apart from each other by a predetermined distance so as to oppose each other;

a protective cover that covers a vicinity of a movement path of the surface modification sheet excluding a portion of the surface modification sheet, placed between the two reels, corresponding to the thermal head; and modification sheet dust processing means for removing dust adhered to the surface modification sheet, the modification sheet dust processing means being disposed in the movement path of the surface modification sheet between the two reels.

9. The modification sheet cartridge according to claim 8, wherein the modification sheet dust processing means includes either one of or both of a dust removing tool and a static electricity removing tool, the dust removing tool removing the dust adhered to the surface modification sheet, the static electricity removing tool allowing static electricity generated at the surface modification sheet to escape.

10. The modification sheet cartridge according to claim 8, wherein the surface modification portion of the surface modification sheet gives glossiness to the surface state of the protective layer that protects the image formed on the recording medium.

11. The modification sheet cartridge according to claim 8, wherein the surface modification portion of the surface modification sheet finishes to a mat tone state the surface state of the protective layer that protects the image formed on the recording medium.

12. An image forming apparatus comprising:

a conveying unit configured to convey a recording medium in a predetermined direction;

a thermal transfer sheet traveling unit configured to cause a thermal transfer sheet to travel in a predetermined direction, the thermal transfer sheet having a dye layer and a protective layer disposed side by side on a ribbon base sheet in a longitudinal direction of the base sheet, the dye layer being thermally transferred onto a surface of the recording medium to form an image thereon, the protective layer being thermally transferred onto a surface of the image formed on the surface of the recording medium to protect the image;

a modification sheet moving unit configured to move a surface modification sheet, the surface modification sheet having a print open portion and a surface modification portion disposed side by side at a ribbon base sheet in a longitudinal direction of the base sheet, the print open portion being provided so as to allow the thermal transfer sheet to directly contact the surface of the recording medium, the surface modification portion being provided to modify a surface state of the protective layer that protects the image formed on the recording medium;

a thermal head that applies thermal energy and thermally transfers sequentially the dye layer and the protective layer onto the recording medium while the dye layer or the protective layer of the thermal transfer sheet opposes the surface of the recording medium; and a modification sheet protecting unit disposed in a movement path of the surface modification sheet, and configured to prevent adhesion of dust to the surface modification sheet or to eliminate the adhesion, wherein, after forming the image onto the recording medium using the thermal transfer sheet and forming the protective layer that protects the image, the surface modification portion of the surface modification sheet is aligned with a plane in which the protective layer is formed, so that heat and pressure are applied by the thermal head to modify the surface state of the protective layer formed at the recording medium.

13. A modification sheet cartridge used in an image forming apparatus in which, after forming an image onto a recording medium using a thermal transfer sheet and forming a protective layer that protects the image, a surface modification portion, disposed at a surface modification sheet, for modifying a surface state of the protective layer is aligned with a plane in which the protective layer is formed, so that heat and pressure are applied by the thermal head to modify the surface state of the protective layer formed on the recording medium, the modification sheet cartridge comprising:

two reels upon which the surface modification sheet is placed so that the surface modification sheet is capable of being taken up and rewound, the two reels being disposed apart from each other by a predetermined distance so as to oppose each other;

a protective cover that covers a vicinity of a movement path of the surface modification sheet excluding a portion of the surface modification sheet, placed between the two reels, corresponding to the thermal head; and a modification sheet dust processing unit configured to remove dust adhered to the surface modification sheet, the modification sheet dust processing unit being disposed in the movement path of the surface modification sheet between the two reels.

* * * * *